US008807713B2

(12) United States Patent
Nakamura et al.

(10) Patent No.: US 8,807,713 B2
(45) Date of Patent: Aug. 19, 2014

(54) LIQUID EJECTION HEAD

(71) Applicant: Canon Kabushiki Kaisha, Tokyo (JP)

(72) Inventors: Yohei Nakamura, Kawasaki (JP); Toru Nakakubo, Kawasaki (JP); Ryota Kashu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/916,696

(22) Filed: Jun. 13, 2013

(65) Prior Publication Data

US 2013/0342614 A1 Dec. 26, 2013

(30) Foreign Application Priority Data

Jun. 22, 2012 (JP) ..... 2012-140705

(51) Int. Cl.
*B41J 2/045* (2006.01)
*B41J 2/14* (2006.01)

(52) U.S. Cl.
USPC ..... 347/71; 347/50

(58) Field of Classification Search
None
See application file for complete search history.

(56) References Cited

U.S. PATENT DOCUMENTS

| | | | | |
|---|---|---|---|---|
| 6,722,035 | B1 * | 4/2004 | Yoshimura | 29/890.1 |
| 7,497,554 | B2 * | 3/2009 | Okuno | 347/50 |
| 8,191,994 | B2 | 6/2012 | Nakakubo et al. | |
| 2013/0093819 | A1 | 4/2013 | Nakakubo et al. | |
| 2013/0162725 | A1 | 6/2013 | Suzuki et al. | |
| 2013/0242003 | A1 * | 9/2013 | Suzuki et al. | 347/68 |
| 2013/0342612 | A1 * | 12/2013 | Nakakubo | 347/71 |

FOREIGN PATENT DOCUMENTS

JP 2007-168319 A 7/2007

* cited by examiner

*Primary Examiner* — Geoffrey Mruk
(74) *Attorney, Agent, or Firm* — Fitzpatrick, Cella, Harper & Scinto

(57) ABSTRACT

A liquid ejection head includes multiple tubular pressure chambers and a stacked body having first substrates and second substrates stacked alternately, in which the first substrates each have multiple first grooves and multiple second grooves formed therein, and the second substrates each has multiple third grooves formed therein, in which, in the multiple first grooves of each of the first substrates, inner surface electrodes are formed, in which counter electrodes are formed in a face of each of the second substrates, and in which a width $W_1$ of each of the inner surface electrodes, a width $W_2$ of each of the counter electrodes, and a width $W_P$ of each of the multiple first grooves satisfy a relation of $W_P<W_2<W_1$.

4 Claims, 20 Drawing Sheets

LIQUID EJECTION HEAD

BACKGROUND OF THE INVENTION

1. Field of the Invention

The present invention relates to a liquid ejection head that ejects liquid.

2. Description of the Related Art

A liquid ejection head for ejecting ink is generally mounted onto an ink jet recording apparatus for recording an image on a recording medium by ejecting the ink. As a mechanism for causing the liquid ejection head to eject ink, there is known a mechanism using a pressure chamber that is shrinkable in volume by a piezoelectric element. In this mechanism, the pressure chamber shrinks due to the deformation of the piezoelectric element to which a voltage is applied, and thus the ink inside the pressure chamber is ejected from an ejection orifice formed at one end of the pressure chamber. As one liquid ejection head including such a mechanism, there is known a so-called shear mode liquid ejection head in which one or two inner walls of the pressure chamber are constituted of a piezoelectric element. In the shear mode liquid ejection head, the pressure chamber is shrunk by shear deformation, instead of extension deformation and shrinkage deformation by voltage application to a piezoelectric element.

Regarding ink jet recording apparatus for industrial applications, there is a demand for use of high viscosity liquid. In order to eject high viscosity liquid, a large ejection force is required for the liquid ejection head. To satisfy this demand, there has been proposed a liquid ejection head called a Gould type, in which the pressure chamber is formed from a tubular piezoelectric member having a circular or rectangular sectional shape. In the Gould type liquid ejection head, the piezoelectric member is deformed by extension and shrinkage in the inward and outward directions (radial direction) about the center of the pressure chamber. In this manner, the pressure chamber expands or shrinks. In the Gould type liquid ejection head, the entire wall surface of the pressure chamber deforms, and this deformation contributes to the ink ejection force. Therefore, as compared to the shear mode liquid ejection head in which one or two wall surfaces are formed from the piezoelectric element, a larger liquid ejection force can be obtained.

In order to obtain a higher resolution, multiple ejection orifices in the Gould type liquid ejection head need to be arranged at a higher density. This requires that pressure chambers corresponding to the respective ejection orifices be arranged highly densely as well. Japanese Patent Application Laid-Open No. 2007-168319 discloses a method of manufacturing a Gould type liquid ejection head in which pressure chambers can be formed at a high density.

The first step of the manufacturing method disclosed in Japanese Patent Application Laid-Open No. 2007-168319 is to form multiple grooves extending in the same direction as one another in each of multiple piezoelectric plates. The multiple piezoelectric plates are then stacked on top of one another with the direction of the grooves aligned, and are cut in a direction orthogonal to the groove direction. The groove portions of each piece of cut piezoelectric plates constitute the inner walls of pressure chambers. Thereafter, piezoelectric members present between the pressure chambers to separate one pressure chamber from another are removed down to a given depth. A supply path plate plus an ink pool plate and a printed wiring board plus a nozzle plate are connected above and below, respectively, the piezoelectric plate where the pressure chambers have been completed. The liquid ejection head is thus completed. According to this manufacturing method, pressure chambers can be arranged in a matrix pattern and can therefore be arranged at a high density. In addition, with this manufacturing method, pressure chambers can be formed with high precision because the workability of forming grooves in a piezoelectric plate is better than that of boring holes in a piezoelectric plate.

In the liquid ejection head manufactured by the manufacturing method of Japanese Patent Application Laid-Open No. 2007-168319, multiple pressure chambers are arranged so that a space is provided between pressure chambers. In other words, wall portions constituting each pressure chamber are constructed independently. Therefore, increasing the length (height) of pressure chambers in order to eject a highly viscous liquid (i.e., to increase liquid ejection force), in particular, reduces the rigidity of the liquid ejection head. A pressure chamber low in rigidity is susceptible to folding and may consequently be incapable of ejecting liquid.

Another problem with a liquid ejection head in which multiple piezoelectric plates are stacked is misalignment between layers due to an error when positioning the piezoelectric plates, which causes each pressure chamber to deform by a different amount and can fluctuate ejection performance from one ejection orifice to another.

SUMMARY OF THE INVENTION

An object of the present invention is therefore to provide a liquid ejection head that is improved in rigidity around pressure chambers and is capable of reducing fluctuations in ejection performance among ejection orifices due to misalignment between layers.

In order to achieve the above-mentioned object, there is provided a liquid ejection head, including:

multiple tubular pressure chambers that respectively communicate with ejection orifices for ejecting liquid, and hold the liquid to be ejected from the ejection orifices, wall portions constituting the multiple tubular pressure chambers being formed of a piezoelectric material and configured to eject the liquid from the ejection orifices by deforming the piezoelectric material; and a stacked body in which first substrates formed of a piezoelectric material and second substrates formed of a piezoelectric material are stacked alternately with each other, in which, on one face of each of the first substrates, multiple first grooves and multiple second grooves are formed, the multiple first grooves extending in a first direction and constituting the multiple tubular pressure chambers together with one of the second substrates, the multiple second grooves being arranged alternately with the multiple first grooves and constituting spaces together with the one of the second substrates, in which, on a face of each of the second substrates that is opposed to a face brought into contact with the one face of the each of the first substrates, multiple third grooves are formed which extend in the first direction and which constitute the spaces together with one of the first substrates, in which, in the multiple first grooves of each of the first substrates, inner surface electrodes are formed which extend from inside the multiple first grooves to each outer side of the multiple first grooves, in which counter electrodes extending in the first direction are formed in the face of each of the second substrates that is brought into contact with the one face of each of the first substrates in places opposed to the multiple first grooves, and in which a width $W_1$ of each of the inner surface electrodes, a width $W_2$ of each of the counter electrodes, and a width $W_P$ of each of the multiple first grooves satisfy a relation of $W_P<W_2<W_1$ in a second direction, which is perpendicular to the first direction and to a stacking direction of the stacked body.

Further features of the present invention will become apparent from the following description of exemplary embodiments with reference to the attached drawings.

DESCRIPTION OF THE EMBODIMENTS

Embodiments of the present invention are described below with reference to the attached drawings.

Figure 1:
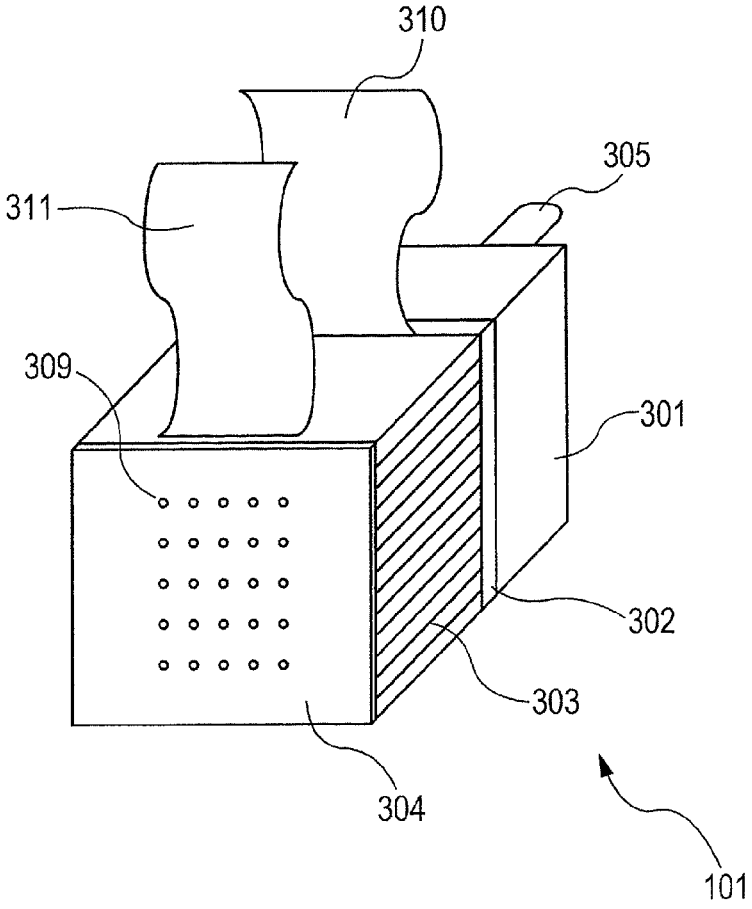
FIG. 1 is a schematic perspective view of an ink jet head unit according to an embodiment of the present invention.
Figure 2:
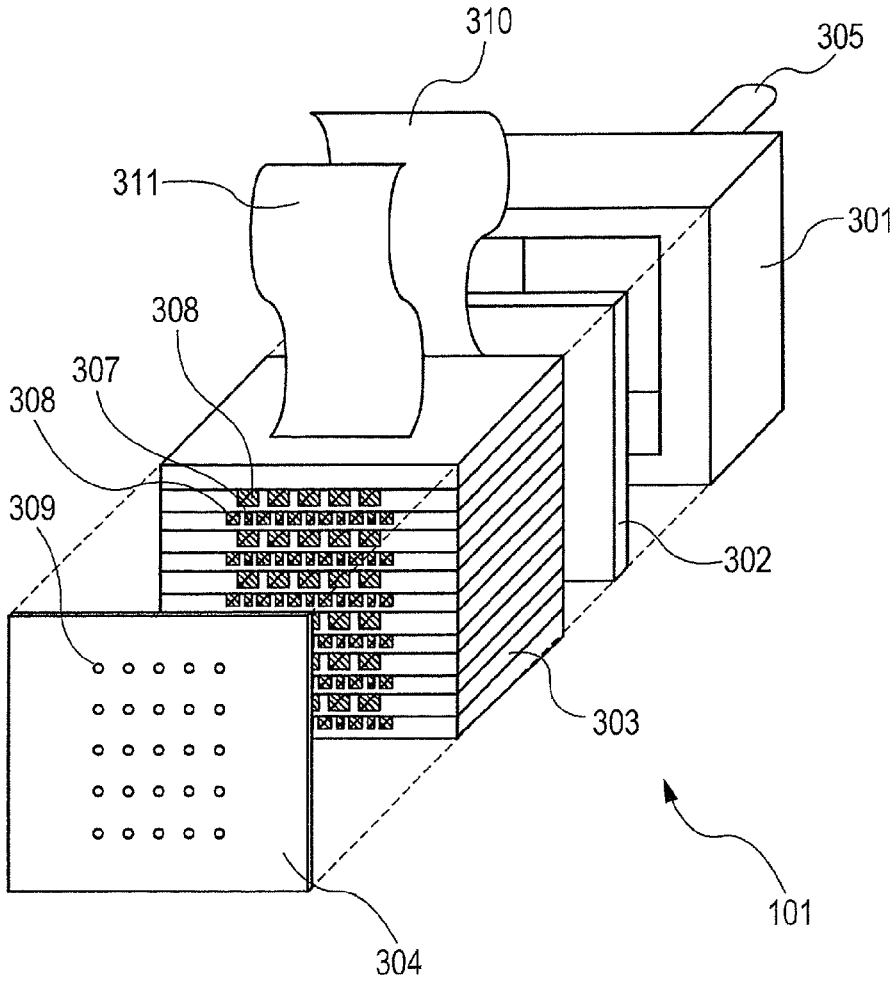
FIG. 2 is a schematic exploded perspective view of the ink jet head unit according to the embodiment.

FIGS. 1 and 2 are respectively a perspective view and exploded perspective view illustrating an ink jet head unit as a liquid ejection head for ejecting liquid such as ink according to an embodiment of the present invention.

Referring to FIGS. 1 and 2, an ink jet head unit 101 includes an orifice plate 304, an ink jet head 303, a rear throttle plate 302, and a common liquid chamber 301. These components are stacked and joined in the order stated. The ink jet head 303 is provided with, as illustrated in FIG. 2, multiple individual liquid chambers (pressure chambers) 307 for holding liquid (ink) and multiple air chambers (spaces) 308 arranged around the respective individual liquid chambers 307 at a distance from the individual liquid chambers 307. The common liquid chamber 301 communicates with the individual liquid chambers 307 of the ink jet head 303 via the rear throttle plate 302. Lines from the ink jet head 303 to the outside are led out from an end face of the ink jet head 303 by a first flexible substrate (FPC) 310 and a second flexible substrate (FPC) 311. The orifice plate 304 is provided with multiple ejection orifices 309 which are arranged in a lattice pattern so as to correspond to the respective individual liquid chambers 307, and which eject ink pressurized in the individual liquid chambers 307 as drops.

Figure 3:
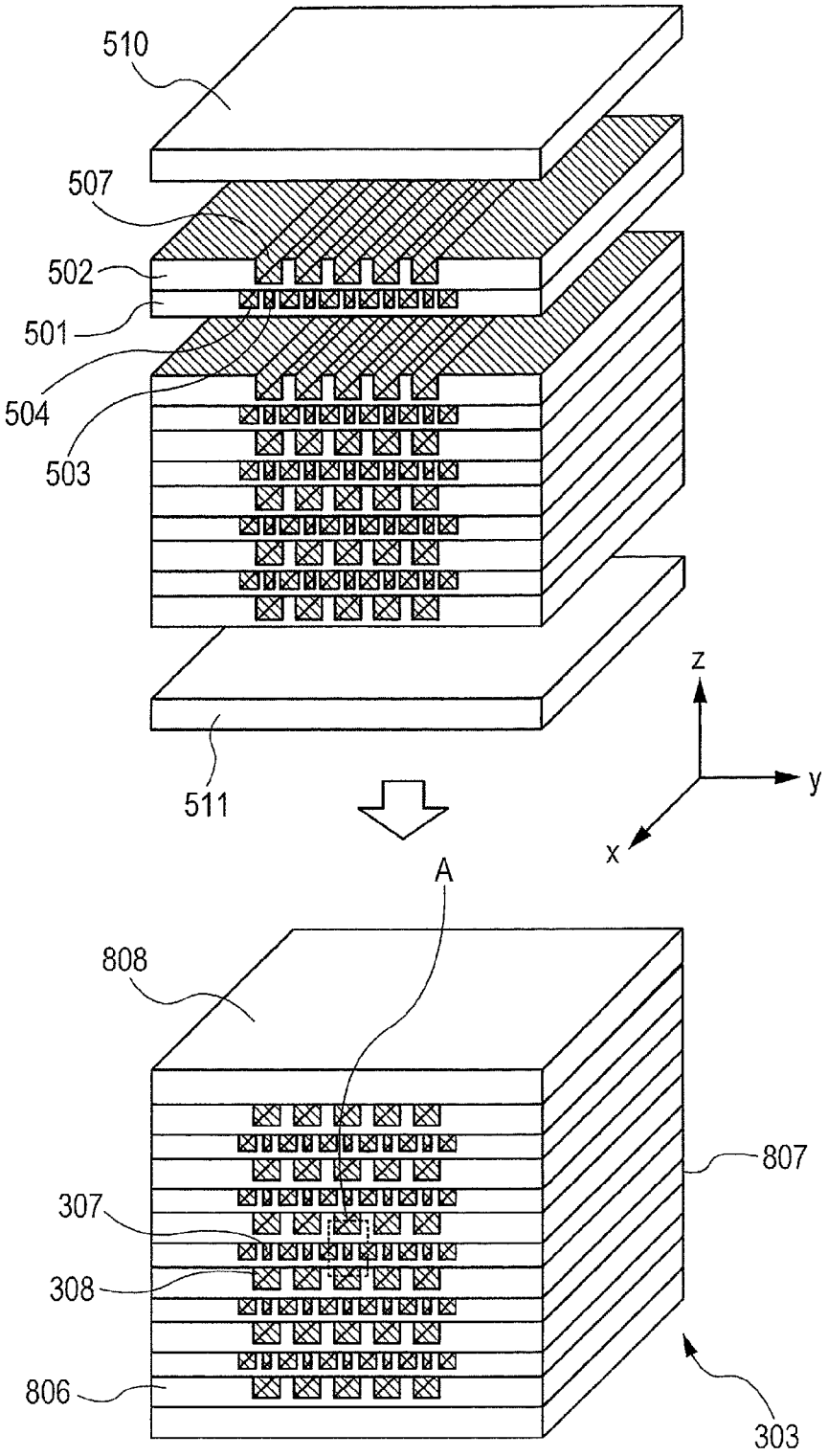
FIG. 3 is a schematic perspective view of an ink jet head.

FIG. 3 is a schematic perspective view illustrating the structure of the ink jet head 303 according to this embodiment. Electrodes described later are omitted from FIG. 3. In the following description, a plane parallel to a substrate is referred to as xy plane and a direction perpendicular to the substrate is referred to as z direction as illustrated in FIG. 3.

The ink jet head 303 has a stacked body in which first piezoelectric substrates 501 and second piezoelectric substrates 502 are stacked alternately in the z direction. Multiple first grooves 503 and multiple second grooves 504 which are arranged alternately with the first grooves 503 are formed on one face of each first piezoelectric substrate 501. On one face of each second piezoelectric substrate, on the other hand, multiple third grooves 507 are formed. The grooves 503, 504, and 507 each extend in an x direction (a first direction). The first piezoelectric substrates 501 and the second piezoelectric substrates 502 are stacked so that a face where the grooves are formed (a groove forming face) and a face where no grooves are formed are brought in contact with each other. As a result, the first grooves 503 and the second piezoelectric substrates 502 constitute the individual liquid chambers 307 described above, which extend in the shape of a tube. The second grooves 504 plus the second piezoelectric substrate 502 and the third grooves 507 plus the first piezoelectric substrate 501 respectively form the air chambers 308 described above, which extend in parallel to the individual liquid chambers 307. The air chambers 308 formed in this way are arranged on a yz plane so as to be sandwiched between the individual liquid chambers 307, which are arranged in a lattice pattern. A third substrate 510 and a fourth substrate 511 are respectively provided at one end and the other end in the stacking direction (the z direction) so as to sandwich the stacked body. The third substrate 510 and the fourth substrate 511 have a role of correcting the overall warping of the stacked substrates.

In this embodiment, wall portions that constitute the individual liquid chambers 307 and wall portions that constitute the air chambers 308 are linked to each other. This enhances the rigidity of the peripheries of the individual liquid chambers 307.

Figure 4:
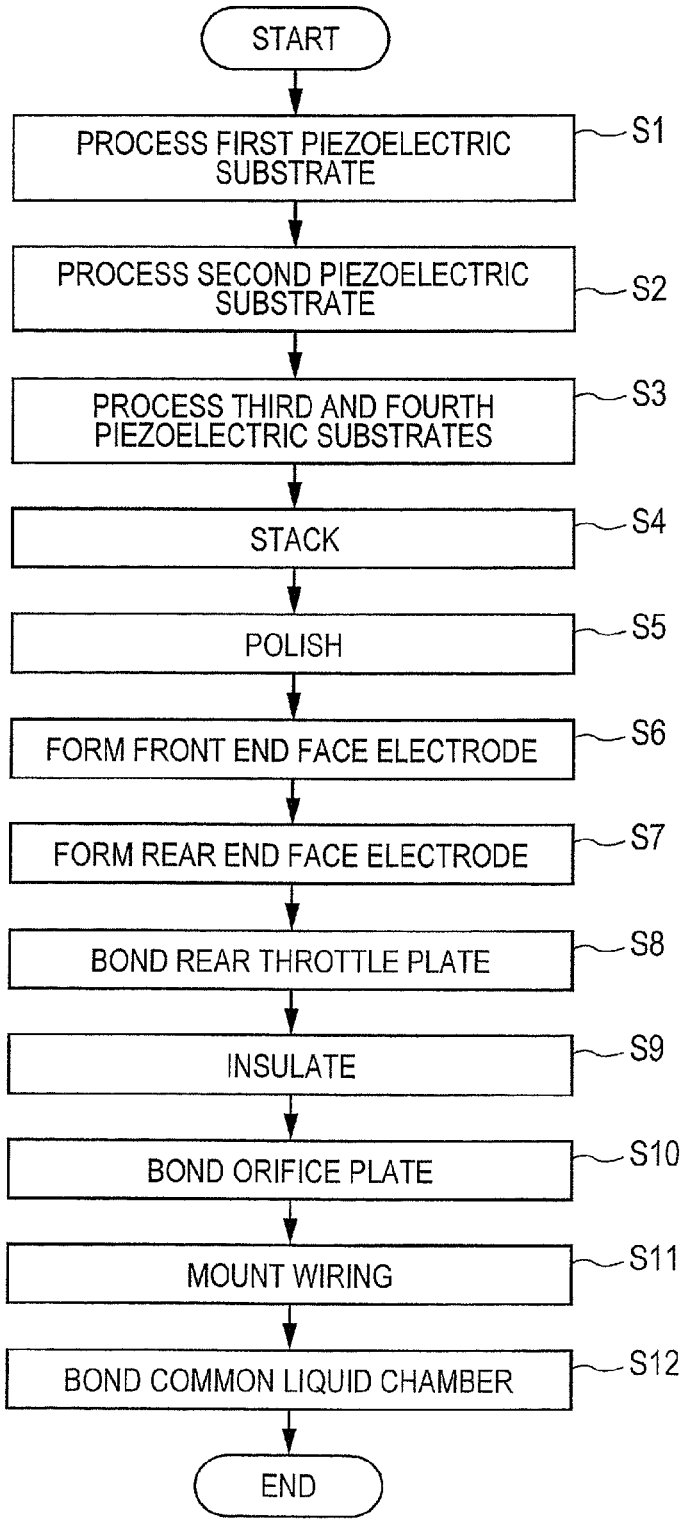
FIG. 4 is a flow chart illustrating a method of manufacturing the ink jet head unit.

A method of manufacturing the ink jet head of this embodiment is described next with reference to a flow chart of FIG. 4. The following description takes as an example a case of an ink jet head that has 5×5 pressure chambers. However, an ink jet head having a different number of pressure chambers can be manufactured by similar steps by changing the number of grooves and the number of stacked piezoelectric substrates.

(Step S1) First-Piezoelectric Substrate Processing

Figure 5:
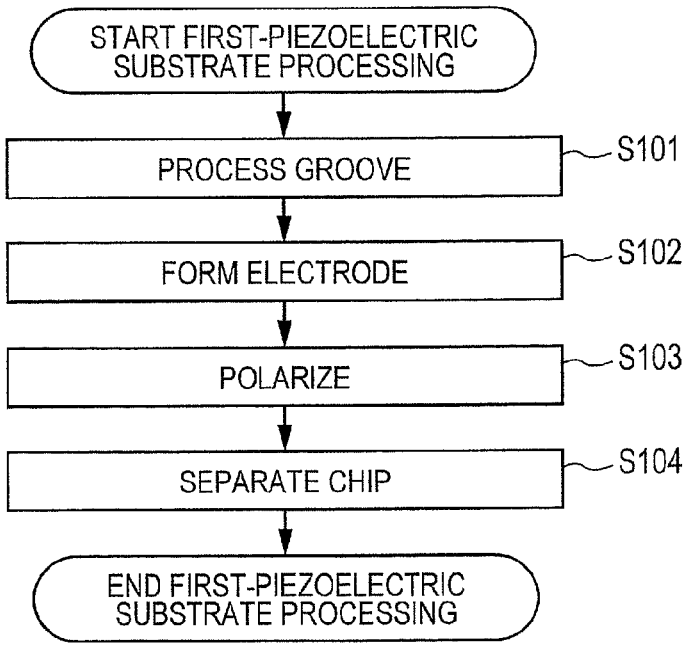
FIG. 5 is a flow chart illustrating a first-piezoelectric substrate processing step.
Figure 6:
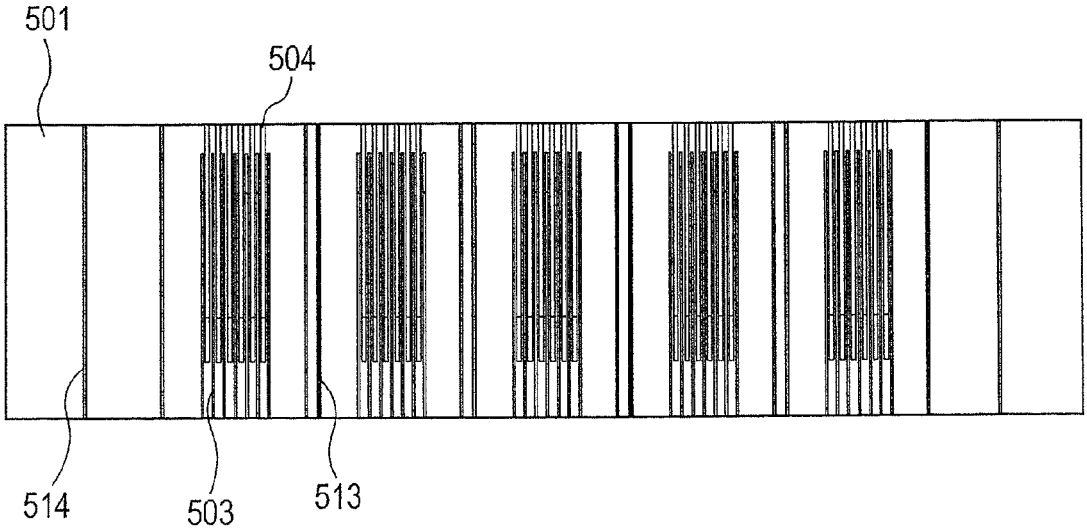
FIG. 6 is a schematic plan view of the first piezoelectric substrate.

FIG. 5 is a flow chart illustrating a first-piezoelectric substrate processing step. FIG. 6 is a plan view illustrating one first piezoelectric substrate on which groove processing described later has been performed. FIGS. 7A to 7H are schematic perspective views illustrating the first-piezoelectric substrate processing step. In the first piezoelectric substrate 501 of FIG. 6, five sets of grooves corresponding to five individual liquid chambers 307 (and five air chambers 308) are arranged. FIGS. 7A to 7H are perspective views of only one set out of the five sets of the grooves, and the following description of the first-piezoelectric substrate processing step deals with the one set of the grooves.

Figure 7A:
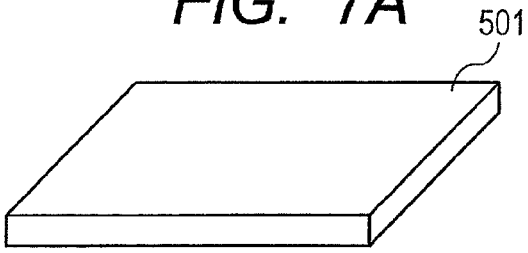
FIGS. 7A, 7B, 7C, 7D, 7E, 7F, 7G, and 7H are schematic perspective views illustrating the first-piezoelectric substrate processing step.

First, as illustrated in FIG. 7A, a flat plate that is formed of a piezoelectric material and has a desired thickness and shape is prepared as the first piezoelectric substrate 501. For example, a lead zirconate titanate (PZT) substrate having the dimensions of 19 mm×70 mm×0.24 mm is suitable for the first piezoelectric substrate 501. First exposure-use alignment grooves 514 (not shown in FIGS. 7A to 7H, see FIG. 6) are formed in the first piezoelectric substrate 501 by grinding that uses a super abrasive wheel. A groove processing step described later uses the first exposure-use alignment grooves 514 as the reference for processing grooves. The first exposure-use alignment grooves 514 may be positioned based on the distance from an end of the substrate, or may be positioned with the use of a metal pattern or the like that is formed on the substrate by photolithography prior to this step to serve as a guide.

Groove processing is performed next on the first piezoelectric substrate 501 (Step S101).

Figure 7B:
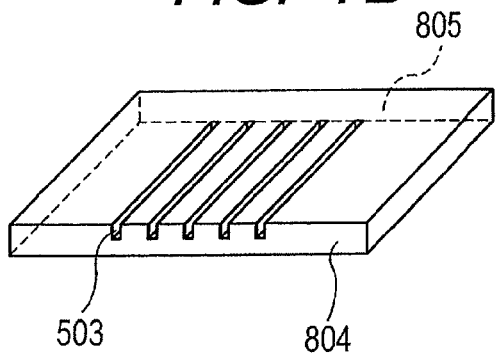

Specifically, multiple first grooves 503 are formed first in the first piezoelectric substrate 501 having a flat plate shape as illustrated in FIG. 7B. In this embodiment, the first grooves 503 that are open-ended on a first side face 804 and closed-ended on a second side face 805 are formed by pulling up the super abrasive wheel, which enters the first piezoelectric substrate 501 from one side face thereof, away from the piezoelectric substrate at some points on the first piezoelectric substrate. The dimensions of the first grooves 503 that are suitable for constituting the liquid chambers of the ink jet head are, for example, 0.12 mm in groove width, 0.12 mm in groove depth, and 0.706 mm (equivalent to 36 nozzles per inch (npi)) in groove pitch.

In addition to the first grooves 503, a groove that functions as a spillway for adhesive in a joining step described later is formed on each outer side of the grooves in the direction in which the grooves are arranged (not shown in FIGS. 7A to 7H, see FIG. 6). First joining-use alignment grooves 513 (not shown in FIGS. 7A to 7H, see FIG. 6) are also formed for alignment in a chip stacking step described later.

Figure 7C:
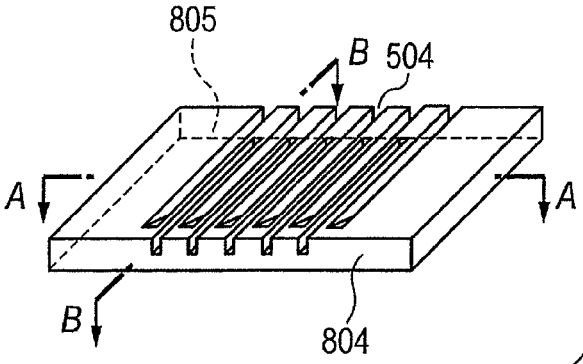

Next, as illustrated in FIG. 7C, multiple second grooves 504 are formed on the first piezoelectric substrate 501 having a flat plate shape so that the multiple first grooves 503 and the multiple second grooves 504 are arranged alternately. The second grooves 504 formed in this embodiment are reverse to the first grooves 503 in that the second grooves 504 are closed-ended on the first side face 804 and are open-ended on the second side face 805. Dimensions suitable for constituting the ink jet head are, for example, 0.12 mm in the width of a wall between one first groove 503 and one second groove 504, 0.346 mm in the groove width of the second grooves 504, and 0.14 mm in the groove depth of the second grooves 504.

Figure 7D:
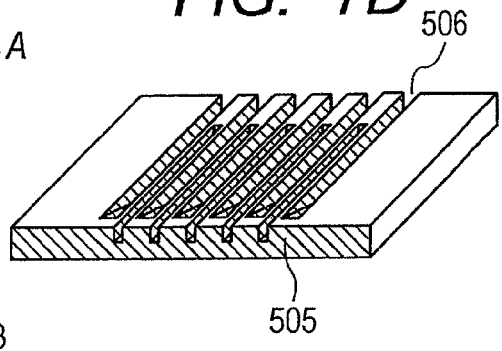
Figure 7E:
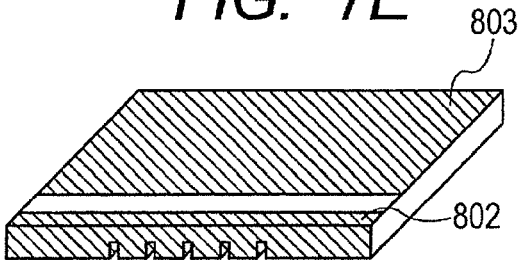

Electrodes are formed next on the first piezoelectric substrate 501 (Step S102). Specifically, as illustrated in FIG. 7D, first electrodes (SIG) 505 are formed in the first grooves 503 and second electrodes (GND) 506 are formed in the second grooves 504. First common wiring 802 and second common wiring 803 are next formed from a metal film on a face of the first piezoelectric substrate 501 opposed to the groove forming face (on the rear face of the first piezoelectric substrate 501) as illustrated in FIG. 7E. Patterns for the first common wiring 802 and the second common wiring 803 are divided from each other in a direction perpendicular to the direction in which the grooves extend (divided in a y direction).

The electrodes can be patterned by patterning that uses lift-off or patterning that uses a laser or polishing. A method of patterning the electrodes by lift-off is described below as an example with reference to FIGS. 8A to 8D. FIGS. 8A to 8D are each a sectional view taken along the line A-A of FIG. 7C.

It is difficult to form a uniform resist film by a normally employed application method, which uses a spin coater, on the groove forming face of the first piezoelectric substrate 501, which has surface irregularities due to the groove processing. A film resist laminate or application with the use of a spray coater is therefore suitable. Exposing the inside of the grooves uniformly is difficult, and a negative resist which only needs the exposure of the outside of the grooves is therefore preferred as the resist.

Figure 8A:
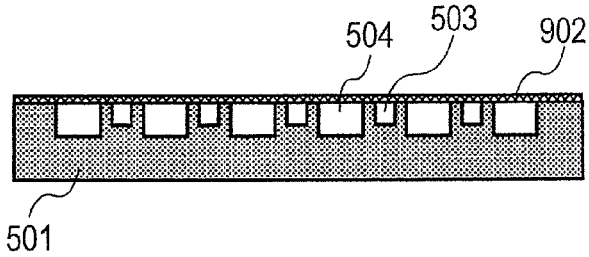
FIGS. 8A, 8B, 8C, 8D, 8E, 8F, 8G, and 8H are schematic sectional views taken along the lines A-A and B-B of FIG. 7C.

First, as illustrated in FIG. 8A, a film resist 902 is laminated onto the first piezoelectric substrate 501. There are voids of approximately 10 μm in diameter on the surface of the first piezoelectric substrate 501, which is a sintered body. For that reason, if the film resist 902 is too thin, the pattern may have missing parts above the voids of the film. It is therefore preferred to use the film resist 902 that is sufficiently thick, for example, 40 μm or more.

Figure 8B:
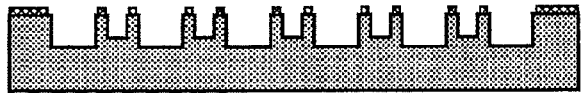

Next, the film resist 902 is patterned by exposure and development as illustrated in FIG. 8B. In lift-off, a resist pattern is formed by photolithography so that the resist remains in parts where the electrode pattern is not to be left. It is preferred to set the resist pattern width smaller than the wall width (the width of the partition wall separating grooves) so that a metal layer formed in the subsequent step covers the entire side walls of the grooves. For example, the resist pattern width is set to 0.06 mm when the wall width is 0.12 mm.

Figure 8C:
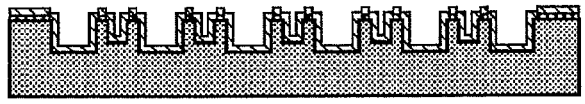

A metal layer for forming electrodes is formed next by sputtering or vapor deposition over the entire substrate, including the resist pattern, as illustrated in FIG. 8C. Sputtering is superior in the ease of forming a film on the side walls of the grooves whereas vapor deposition is superior in the ease of patterning by lift-off.

Figure 8D:
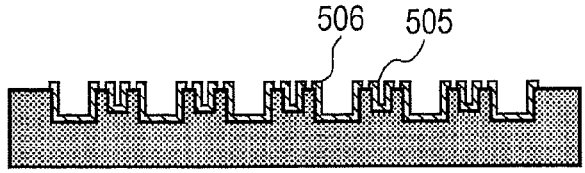
Figure 8E:
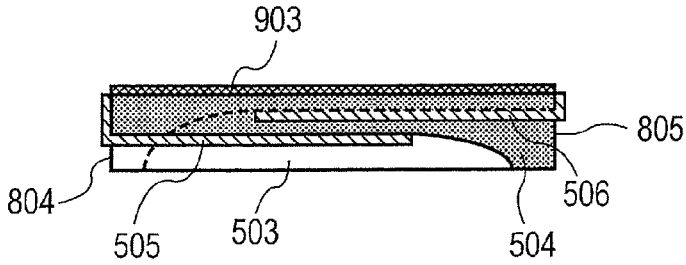
Figure 8F:
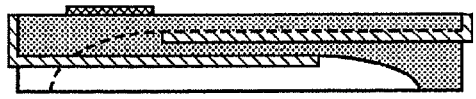
Figure 8G:
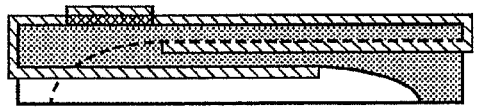
Figure 8H:
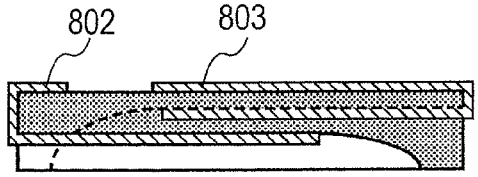

The resist is then removed as illustrated in FIG. 8D. A part of the metal film that has been formed above the resist is peeled off along with the resist and, ultimately, a desired metal film pattern is formed.

The electrodes are formed by, for example, forming a Cr film to a thickness of approximately 20 nm as a base layer and further forming an Au film to a thickness of approximately 1,000 nm as an electrode layer. Alternatively, the electrodes may be formed by forming a Cr film to a thickness of approximately 20 nm as a base layer, forming and patterning an approximately 50 nm-thick Pd film, conducting Ni plating with the Pd film as a seed layer to a thickness of approximately 1,000 nm, and conducting displacement plating in which Ni on the surface is displaced with Au. The latter method which uses plating is particularly favorable because the thinness of the film in lift-off means less remaining flash and an improved ease of patterning, and because the use of Au restricted to the surface keeps the cost low.

In electrode patterning that uses a laser or polishing, on the other hand, a metal film is formed first on the entire substrate by sputtering, vapor deposition, electroless plating, or the like. At this point, the metal film is formed on the first side face 804, where the open ends of the first grooves 503 are located, and the second side face 805, where the open ends of the second grooves 504 are located, as well. An unnecessary part of the formed metal film, namely, a part of the metal film that is formed on the surface part of the groove forming face, is then removed with the use of a laser or by polishing. A desired electrode pattern is thus formed. The first electrodes (SIG) 505 establish electrical connection to one another via the part of the metal film that is formed on the first side face 804. The second electrodes (GND) 506 establish electrical connection to one another via the part of the metal film that is formed on the second side face 805.

The common wiring can be patterned by lift-off or etching of a photo resist that uses photolithography, or by removing an unnecessary part with the use of a laser, or through dicing or milling. In common wiring patterning, unlike electrode patterning, a uniform resist film can be formed by spin coating which is a normally employed resist application method because there are no surface irregularities on the substrate face opposed to the groove forming face. FIGS. 8E to 8H are step diagrams of common wiring patterning that uses lift-off by photolithography, and are each a sectional view taken along the line B-B of FIG. 7C. Similarly to the case of the electrode patterning, a film resist 903 is formed on the substrate face opposed to the groove forming face (see FIG. 8E), the resist is patterned (see FIG. 8F), a metal layer is formed (see FIG. 8G), and then the resist is removed (see FIG. 8H). Alternatively, thick electrodes may be formed by forming a thin film of Pd and conducting plating with the Pd film as a seed layer as is the case for electrode patterning.

The first common wiring 802 is electrically connected to the first electrodes (SIG) 505 via the first side face 804 where the open ends of the first grooves 503 are located. The second common wiring 803, on the other hand, is electrically connected to the second electrodes (GND) 506 via the second side face 805, where the open ends of the second grooves 504 are located.

Figure 7F:
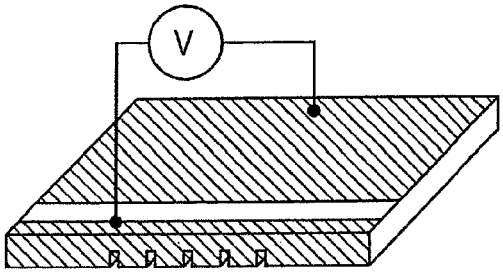

Polarization is conducted next on the first piezoelectric substrate 501 as illustrated in FIG. 7F (Step S103).

In this embodiment, wall portions constituting the first grooves 503 are polarized in three different directions. The first electrodes (SIG) 505 are given a positive electric potential, the second electrodes (GND) 506 and a third electrode (GND) 508 are given a GND electric potential, and a high electric field is applied between the first electrodes and the second electrodes. Specifically, the substrate is heated around 100 to 150° C. and, in the heated state, an electric field as high as 1 to 2 kV/mm is applied between the first electrodes (SIG) 505 and the second electrodes (GND) 506 for a given period of time. The first common wiring 802 and the second common wiring 803 which are formed on the substrate face opposed to the groove forming face are large in pattern size, and thus using the first common wiring 802 and the second common wiring 803 as electrode pads facilitates wiring to a power source device that generates a high electric field. The gap between electrodes above each flow path partition wall (partition wall separating grooves) is as narrow as 0.06 mm, and applying a high electric field of 1 to 2 kv/mm in the air is likely to cause atmospheric discharge or creeping discharge. It is therefore desired to conduct polarization in a highly insulative oil such as silicone oil (dielectric breakdown voltage: 10 kV/mm or more). Silicone oil can be removed after the polarization with a hydrocarbon-based solvent such as xylene, benzene, or toluene, or a chlorinated hydrocarbon-based solvent such as methyl chloride, 1.1.1-trichloroethane, or chlorobenzene.

Aging processing may be performed as necessary after the polarization. Specifically, the first piezoelectric substrate 501 on which polarization has been performed is kept at a raised temperature for a given period of time, to thereby stabilize the piezoelectric characteristics thereof. The aging processing is accomplished by, for example, leaving the first piezoelectric substrate 501 on which the polarization has been performed in an oven set to 100° C. for ten hours.

Lastly, chip separation is executed (Step S104).

Figure 7G:
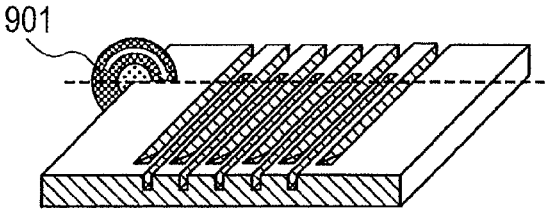

Specifically, a part of the first piezoelectric substrate 501 that has the second side face 805 is removed first so that the first grooves 503 are open-ended on the removed face as illustrated in FIG. 7G. Dicing, polishing, and laser abrasion can be given as removal method examples. The first grooves 503 need to be open-ended at a corresponding side face in order to function as the individual liquid chambers 307. In this step, a part of the second common wiring 803 that is formed on the second side face 805 is removed as well. As a result, the second electrodes (GND) 506 in the second grooves 504 are electrically isolated from one another and electrically isolated from the second common wiring 803, which are formed on the substrate face opposed to the groove forming face.

Figure 7H:
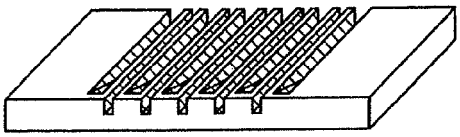

After that, as illustrated in FIG. 7H, the first common wiring 802 that is formed on the first side face 804 is removed. Dicing, polishing, and laser abrasion can be given as removal method examples. The first common wiring 802 formed on the first side face 804 is removed in this step, and hence the first electrodes (SIG) 505 in the first grooves 503 are electrically isolated from one another. In this embodiment, the part of the first common wiring 802 that is formed on the first side face 804 is removed in a manner that ensures that the second grooves 504 are closed-ended on the first side face 804.

The first piezoelectric substrate 501 of FIG. 5 is then cut into pieces for every five nozzles (one set). In this way, five small chips having the dimensions of 10 mm×10 mm×0.24 mm are thus cut out of the first piezoelectric substrate 501.

Through the processing step described above, polarization can be conducted with the second grooves 504 which constitute air chambers closed on the other side face of the first piezoelectric substrate 501 (the first side face 804).

(Step S2) Second-Piezoelectric Substrate Processing

Figure 9:
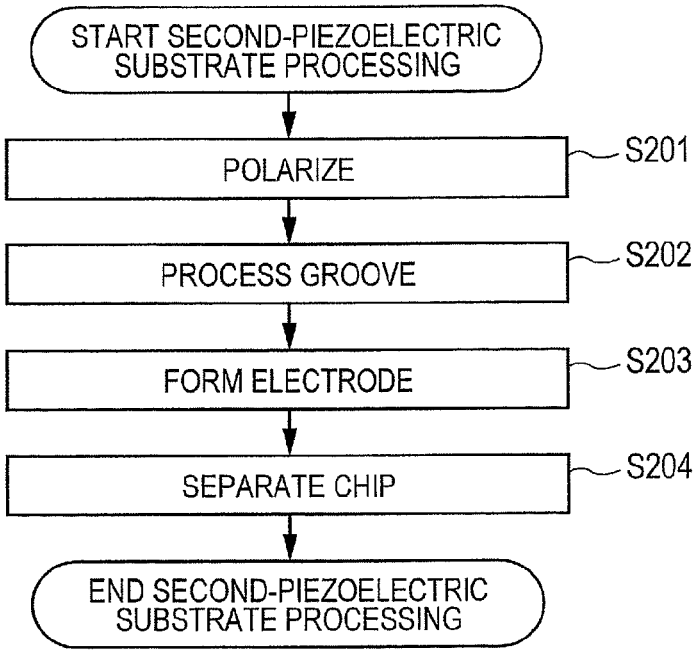
FIG. 9 is a flow chart illustrating a second-piezoelectric substrate processing step.
Figure 10:
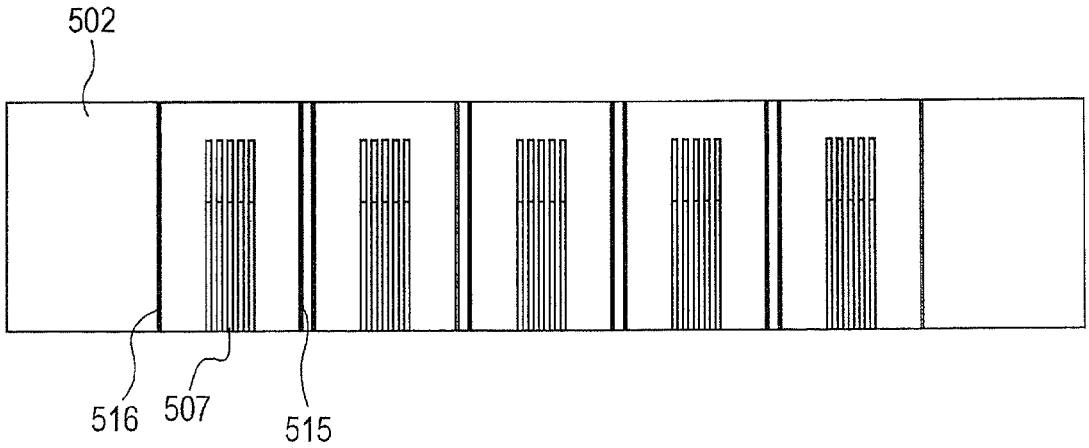
FIG. 10 is a schematic plan view of the second piezoelectric substrate.

FIG. 9 is a flow chart illustrating a second-piezoelectric substrate processing step. FIG. 10 is a plan view illustrating one second piezoelectric substrate on which groove processing described later has been performed. FIGS. 11A to 11D are schematic perspective views illustrating the second-piezoelectric substrate processing step. In the second piezoelectric substrate 502 of FIG. 10, five sets of grooves corresponding to the air chambers 308 are arranged. FIGS. 11A to 11D are perspective views of only one set out of the five sets of the grooves, and the following description of the second-piezoelectric substrate processing step deals with the one set of the grooves.

A PZT substrate having the dimensions of, for example, 15 mm×70 mm×0.43 mm is prepared as the second piezoelectric substrate 502 first, and then polarization is conducted on the second piezoelectric substrate 502 (Step S201).

The polarization, which is conducted after groove processing in the step of processing the first piezoelectric substrate 501, is conducted prior to groove processing, that is, when the substrate is flat, in the step of processing the second piezoelectric substrate 502. Specifically, electrodes are formed on both the entire front face and rear face of the flat substrate, the substrate is heated around 100 to 150° C. and, in the heated state, an electric field as high as 1 to 2 kV/mm is applied between the electrodes for a given period of time. This polarization polarizes the second piezoelectric substrate 502 uniformly in a direction perpendicular to the principal plane of the second piezoelectric substrate 502. The polarization may be conducted in insulative oil as is the case for the first piezoelectric substrate 501 or in the air. After the polarization, the electrodes on the front face are removed by etching or polishing.

Groove processing is performed next on the polarized second piezoelectric substrate 502 (Step S202).

Specifically, second exposure-use alignment grooves 516 (see FIG. 10) are formed first in the second piezoelectric substrate 502 by grinding that uses a super abrasive wheel. The second exposure-use alignment grooves 516 are used as a reference for the processing of grooves in the subsequent groove processing step. The second exposure-use alignment grooves 516 may be positioned based on the distance from an end of the substrate, or may be positioned with the use of a metal pattern or the like that is formed on the substrate by photolithography prior to this step to serve as a guide.

Figure 11A:
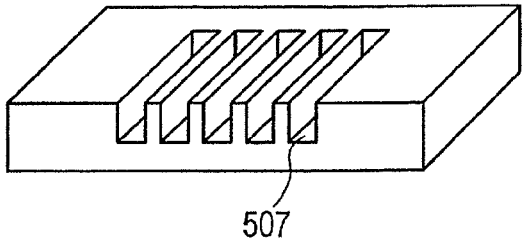
FIGS. 11A, 11B, 11C, and 11D are schematic perspective views illustrating the second-piezoelectric substrate processing step.

Multiple third grooves 507 are formed next in the second piezoelectric substrate 502 as illustrated in FIG. 11A. In this embodiment, the super abrasive wheel enters the second piezoelectric substrate 502 from one side face of the second piezoelectric substrate, and the third grooves 507 that are closed-ended on the other side face of the second piezoelectric substrate are formed by pulling up the super abrasive wheel away from the second piezoelectric substrate at some points on the piezoelectric substrate during grinding. The dimensions of the third grooves 507 that are suitable for constituting the ink jet head are, for example, 0.36 mm in groove width, 0.31 mm in groove depth, and 0.706 mm (equivalent to 36 npi) in groove pitch.

Figure 11B:
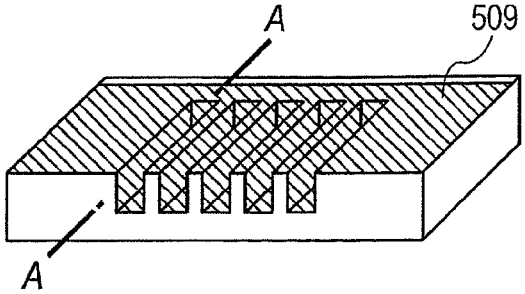
Figure 11C:
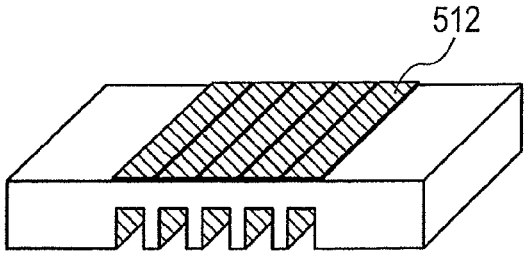

Electrodes are formed next on the second piezoelectric substrate 502 (Step S203). Specifically, a fourth electrode (GND) 509 is formed in the third grooves 507 as illustrated in FIG. 11B, and a fifth electrode (SIG) 512 is formed from a metal film on the face of the second piezoelectric substrate 502 that is opposed to the groove forming face of the second piezoelectric substrate 502 as illustrated in FIG. 11C. It is sufficient if the fourth electrode (GND) 509 is patterned so that the electrode is formed on at least the bottom faces of the third grooves 507. An electrode formed on all the inner faces of the third grooves 507 may also be used as the fourth electrode 509. While forming the electrode on the groove forming face as well is an option, it is necessary to take care that the electrode does not come into contact with a side face that constitutes a rear end face 807 (see FIG. 3) of the ink jet head 303 after the substrate is made into chips, because wiring is conducted on the rear end face 807 after a stacking step, which is described later. The pattern shape of the fifth electrode (SIG) 512 is divided along the third grooves 507 formed in the rear face.

The fourth electrode (GND) 509 can be patterned by lift-off or polishing, or with the use of a laser. An electrode patterning method that uses lift-off is described below as an example with reference to FIGS. 12A to 12D. FIGS. 12A to 12D are each a sectional view taken along the line A-A of FIG. 11B.

It is difficult to form a uniform resist film by a normally employed application method, which uses a spin coater, on the groove forming face of the second piezoelectric substrate 502, which has surface irregularities due to the groove processing. A film resist laminate or application with the use of a spray coater is therefore suitable. Exposing the inside of the grooves uniformly is difficult, and a negative resist which only needs the exposure of the outside of the grooves is therefore preferred as the resist.

Figure 12A:
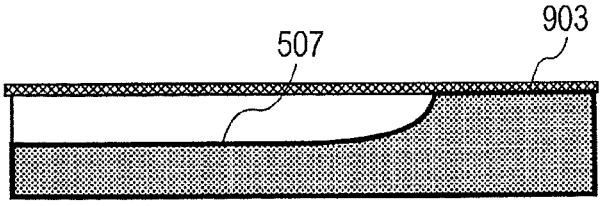
FIGS. 12A, 12B, 12C, and 12D are schematic sectional views taken along the line A-A of FIG. 11B.
Figure 12B:
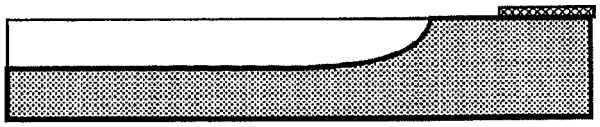
Figure 12C:
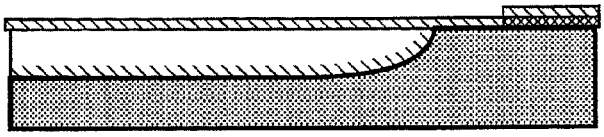
Figure 12D:
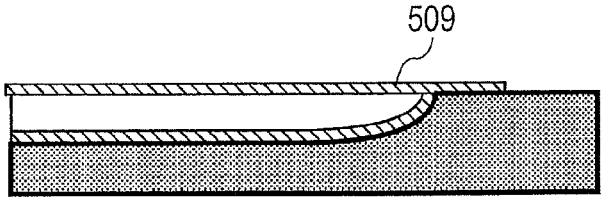

First, as illustrated in FIG. 12A, the film resist 903 is laminated onto the second piezoelectric substrate 502. Next, a resist pattern is formed by photolithography so that the resist remains in parts where the electrode pattern is not to be left as illustrated in FIG. 12B. A metal layer for forming electrodes is formed next by sputtering or vapor deposition over the entire substrate, including the resist pattern, as illustrated in FIG. 12C. The resist is then removed as illustrated in FIG. 12D. A part of the metal film that has been formed above the resist is peeled off along with the resist and, ultimately, a desired metal film pattern is formed.

The electrodes are formed by, for example, forming a Cr film to a thickness of approximately 20 nm as a base layer and further forming an Au film to a thickness of approximately 1,000 nm as an electrode layer. Alternatively, the electrodes may be formed by forming a Cr film to a thickness of approximately 20 nm as a base layer, forming and patterning an approximately 50 nm-thick Pd film, conducting Ni plating with the Pd film as a seed layer to a thickness of approximately 1,000 nm, and conducting displacement plating in which Ni on the surface is displaced with Au. The latter method which uses plating is particularly favorable because the thinness of the film in lift-off means an improved ease of patterning, and because the use of Au restricted to the surface keeps the cost low.

In electrode patterning that uses a laser or polishing, on the other hand, a metal film is formed first on the entire substrate by sputtering, vapor deposition, electroless plating, or the like. An unnecessary part of the formed metal film, namely, a part of the metal film that is formed on the surface part of the groove forming face, is then removed with the use of a laser or by polishing. A desired electrode pattern is thus formed.

The fifth electrode (SIG) 512 can be patterned by lift-off or etching of a photo resist that uses photolithography, or by removing an unnecessary part with the use of a laser, or through dicing or milling. In the patterning of the fifth electrode (SIG) 512, a uniform resist film can be formed by spin coating which is a normally employed resist application method because there are no surface irregularities on the substrate face opposed to the groove forming face, unlike the groove forming face. Similarly to the case of the groove forming face, a film of a resist is formed on the substrate face opposed to the groove forming face, the resist is patterned, a metal layer is formed, and then the resist is removed. Alternatively, thick electrodes may be formed by forming a thin film of Pd and conducting plating with the Pd film as a seed layer as is the case for the groove forming face. The width of the electrode pattern which is approximately the same as the groove width can be set to, for example, 0.15 mm or so by taking into account an alignment error that may occur during stacking or exposure.

Figure 11D:
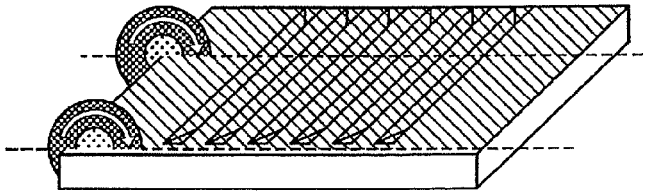

Lastly, chip separation is executed (Step S204). Specifically, a part of the second piezoelectric substrate 502 is removed first as illustrated in FIG. 11D. Dicing, polishing, and laser abrasion can be given as removal method examples. Even if a metal film has been formed on the side faces of the substrate, this step removes the metal film, with the result that each fifth electrode (SIG) 512 is electrically isolated from another fifth electrode (SIG) 512. In this embodiment, the part of the second piezoelectric substrate 502 is removed in a manner that ensures that the third grooves 507 are closed-ended on one side face of the second piezoelectric substrate 502. Similarly to the case of the first piezoelectric substrate 501, the second piezoelectric substrate 502 of FIG. 10 is then cut into pieces for every five nozzles, thereby cutting five small chips having the dimensions of 10 mm×10 mm×0.43 mm out of the second piezoelectric substrate 502.

Figure 13:
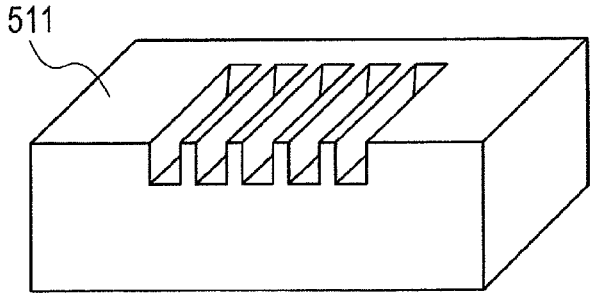
FIG. 13 is a schematic perspective view illustrating a modification example of a fourth substrate.

(Step S3) Third-Piezoelectric Substrate and Fourth-Piezoelectric Substrate Processing The third substrate 510 and the fourth substrate 511 are processed next. The third substrate 510 and the fourth substrate 511 each have the dimensions of, for example, 10 mm×10 mm×3 mm. No grooves or patterns are formed on the third substrate 510 and the fourth substrate 511 in this embodiment. However, grooves may be formed in the fourth substrate 511 as illustrated in FIG. 13. In this case, the fourth substrate 511 in which grooves are formed is used in place of the second piezoelectric substrate 502 that is the lowermost layer of the stacked body. There is no particular need to form electrodes in the case of the fourth substrate 511 of FIG. 13.

(Step S4) Stacking

Figure 14:
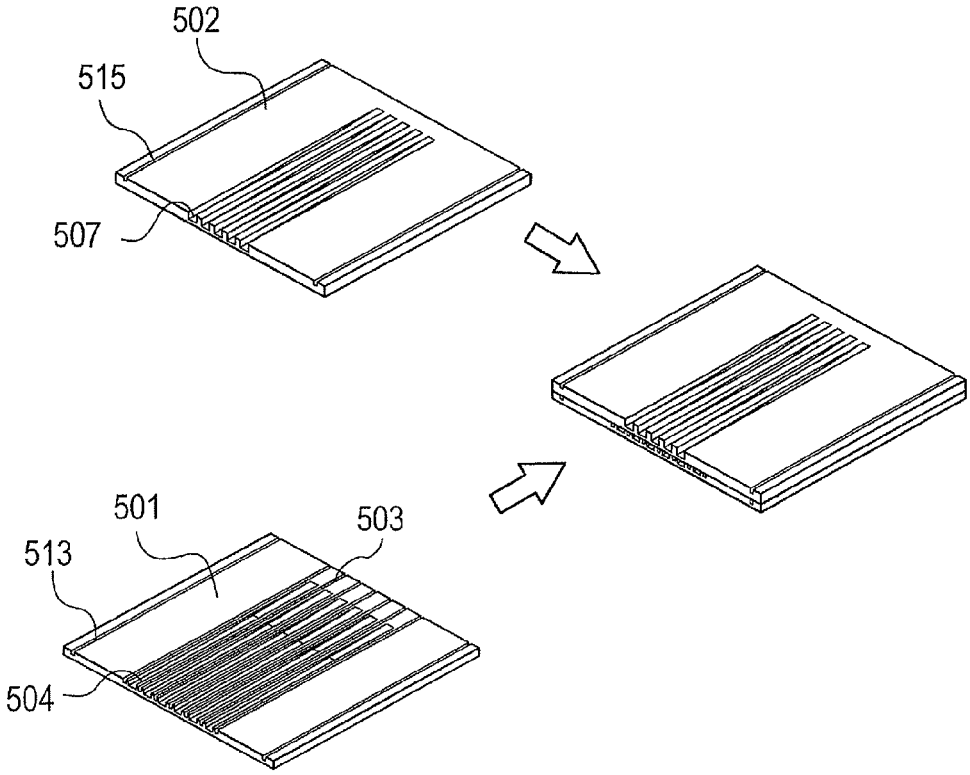
FIG. 14 is a schematic perspective view illustrating a step of stacking the first piezoelectric substrate and the second piezoelectric substrate.

A step of stacking the first piezoelectric substrate 501 and the second piezoelectric substrate 502 is conducted next. FIG. 14 is a perspective view illustrating this stacking step.

Through the preceding steps, the first grooves 503 which form the individual liquid chambers 307 and the second grooves 504 which are arranged alternately with the first grooves 503 to form the air chambers 308 have been formed in the first piezoelectric substrate 501. The first electrodes (SIG) 505 are formed on the inner faces of the first grooves 503, and the second electrodes (GND) 506 are formed on the inner faces of the second grooves 504. The third electrode (GND) 508 is formed on the entire face of the first piezoelectric substrate 501 that is opposed to the groove forming face of the first piezoelectric substrate 501. In the second piezoelectric substrate 502, the third grooves 507 are formed, which form the air chambers 308 adjacent to the individual liquid chambers 307 in the substrate stacking direction. The fourth electrode (GND) 509 is formed on the entire surface of the second piezoelectric substrate 502 including the inner faces of the third grooves 507. The fifth electrode (SIG) 512 is formed on the face of the second piezoelectric substrate 502 that is opposed to the groove forming face of the second piezoelectric substrate 502 in places that correspond to the locations of the third grooves 507.

The first piezoelectric substrate 501 and the second piezoelectric substrate 502 are joined as illustrated in FIG. 14. The piezoelectric substrates can be joined with the use of, for example, an epoxy-based adhesive. In order to avoid filling the grooves with the adhesive, the amount of the adhesive needs to be controlled appropriately. The adhesive can be applied by forming a thin uniform adhesive layer on another flat substrate through spin coating, screen printing, or the like, pressing a surface to be bonded against the adhesive layer, and then pulling the surface away. A thin uniform adhesive layer is thus formed on the bonding surface. After the adhesive is applied, the first piezoelectric substrate 501 and the second piezoelectric substrate 502 are positioned with a minute gap left between the first piezoelectric substrate 501 and the second piezoelectric substrate 502, and the piezoelectric substrates 501 and 502 are then bonded by pressure bonding. The thickness of the adhesive as a guide is about 4 μm before the bonding and about 2 μm after the bonding. The amount of adhesive that runs over to the individual liquid chambers 307 and the air chambers 308 is reduced effectively by forming the grooves 513 and grooves 515 on the outside in the groove arrangement direction as illustrated in FIGS. 6 and 10 and using the grooves 513 and 515 as spillways for the adhesive.

In order to align the piezoelectric substrates 501 and 502 during the stacking, an end face of each chip cut out of the piezoelectric substrates 501 and 502 may be pushed against positioning pins. Alternatively, the piezoelectric substrates 501 and 502 may be aligned with the use of a camera in order to improve the positioning accuracy. In the alignment with the use of a camera, edges of the chips, grooves, alignment marks patterned when the electrodes are formed, or the like can be used as a guide.

The two piezoelectric substrates 501 and 502 joined in this manner constitute one unit, and multiple units are stacked and joined to one another to form a stacked body. The third substrate 510 and the fourth substrate 511 are respectively joined at one end and the other end of the stacked body so as to sandwich the stacked body. The ink jet head 303 is thus manufactured as illustrated in FIG. 3. The third substrate 510 and the fourth substrate 511 do not need to be piezoelectric substrates. In the case where heating is required to join the substrates, it is desired to form the third substrate 510 and the fourth substrate 511 from a material that has a thermal expansion coefficient close to those of the first piezoelectric substrate 501 and the second piezoelectric substrate 502.

(Step S5) Polishing

Next, an end face 806 and the end face 807 (see FIG. 3) where the individual liquid chambers 307 of the ink jet head 303 are open are leveled by polishing. Abrasive grains can be used for the polishing. It is preferred to give the end faces 806 and 807 a post-polishing surface roughness Ra of about 0.4 μm for electrode forming steps described later. It is also preferred to give the end faces 806 and 807 a levelness within 10 μm and to set the parallelism between the end faces 806 and 807 to 30 μm or less in order to bond the orifice plate 304 and the rear throttle plate 302 (see FIG. 2) with precision.

(Step S6) Front End Face Electrode Formation

Figure 15:
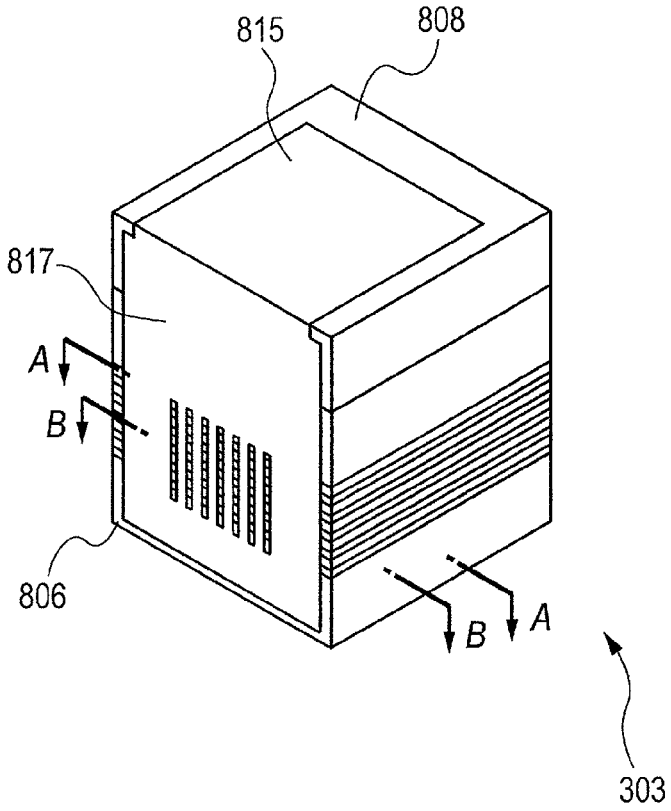
FIG. 15 is a schematic perspective view illustrating a pattern of lead-out wiring (GND).

A front end face electrode forming step is described next with reference to FIGS. 15 to 17.

In this step, lead-out wiring (GND) 817 from the GND electrode provided in each air chamber 308 is formed on the front end face 806 of the ink jet head 303. FIG. 15 is a perspective view illustrating the lead-out wiring (GND) 817. The lead-out wiring (GND) 817 is led from the front end face 806 of the ink jet head 303 onto an upper end face 808, and is connected to the second FPC 311 (see FIGS. 1 and 2) in a mounted wiring connecting portion (GND) 815 in a step described later.

Electrode patterning on the front end face 806 is described with reference to FIGS. 16A to 16D. FIGS. 16A to 16D are sectional views taken along the line A-A of FIG. 15.

It is difficult to form a uniform resist film by a normally employed application method, which uses a spin coater, on the front end face 806, which has surface irregularities such as the individual liquid chambers 307 and the air chambers 308. A film resist laminate is therefore suitable. A negative resist is used for the film.

In lift-off, a resist pattern is formed by photolithography so that the resist remains in parts where the electrode pattern is not to be left. A metal layer that is to constitute electrodes is formed on the entire front end face 806, including the resist pattern, by performing sputtering or vapor deposition from above the resist pattern. The resist is then removed and a part of the metal film that has been formed above the resist is peeled off along with the resist. A desired metal film pattern is ultimately formed.

Figure 16A:
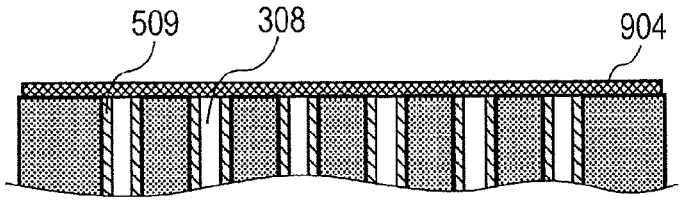
FIGS. 16A, 16B, 16C, and 16D are schematic sectional views taken along the line A-A of FIG. 15.
Figure 16B:
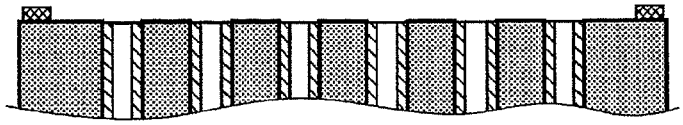
Figure 16C:
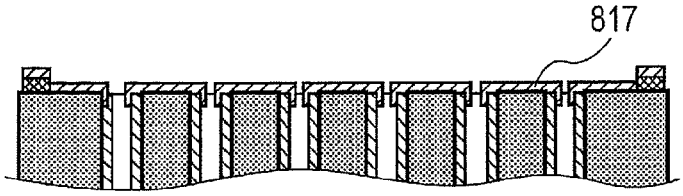
Figure 17:
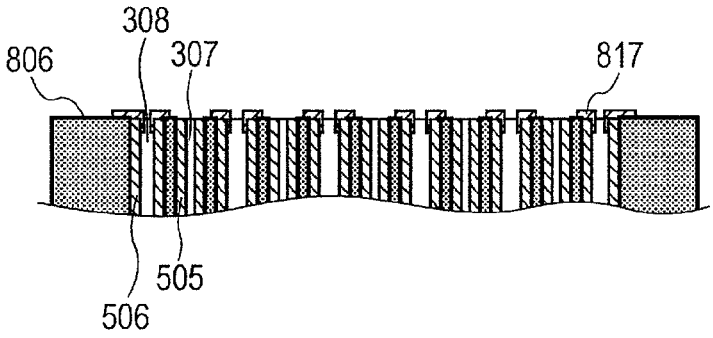
FIG. 17 is a schematic sectional view taken along the line B-B of FIG. 15.

Specifically, a film resist 904 is laminated onto the front end face 806 first as illustrated in FIG. 16A. The openings of the air chambers 308 and the peripheries thereof are next exposed by exposure and development as illustrated in FIG. 16B. When exposing the air chambers 308 and peripheries thereof, the individual liquid chambers 307 and peripheries thereof are kept covered with the resist. An electrode layer is further formed on the front end face 806 as illustrated in FIG.

Figure 16D:
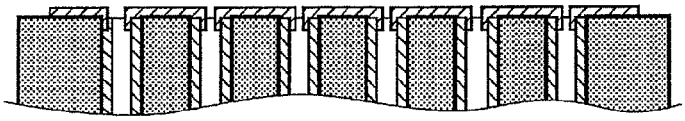

16C, thereby electrically connecting the electrode layer to the electrodes (GND) 508 and 509 in the air chambers 308. The electrode layer is formed with a mask covering the upper end face 808 as well, to thereby form the mounted wiring connecting portion (GND) 815, where a connection to the second FPC 311 is made. The resist is then removed as illustrated in FIG. 16D, with the result that the electrode is formed to have a desired pattern by lift-off. FIG. 17 illustrates the electrode pattern in sectional view taken along the line B-B of FIG. 15. The lead-out wiring (GND) 817 is electrically connected to the second electrodes (GND) 506 formed in the air chambers 308, and is not electrically connected to the first electrodes (SIG) 505 formed in the individual liquid chambers 307 as illustrated in FIG. 17.

The electrodes are formed by, for example, forming a Cr film to a thickness of approximately 20 nm as a base layer and further forming an Au film to a thickness of approximately 1,000 nm as an electrode layer. Alternatively, the electrodes may be formed by forming a Cr film to a thickness of approximately 20 nm as a base layer, forming and patterning an approximately 50 nm-thick Pd film, conducting Ni plating with the Pd film as a seed layer to a thickness of approximately 1,000 nm, and conducting displacement plating in which Ni on the surface is displaced with Au. A gap of approximately 1 to 2 μm is provided by the adhesive layer between each piezoelectric substrate 501 and each piezoelectric substrate 502. The thickness of the gap is sufficient for obtaining electrical connection beyond the gap. The latter method which uses plating is particularly favorable because the thinness of the film in lift-off means an improved ease of patterning, and because the use of Au restricted to the surface keeps the cost low.

(Step S7) Rear End Face Electrode Formation

Figure 18:
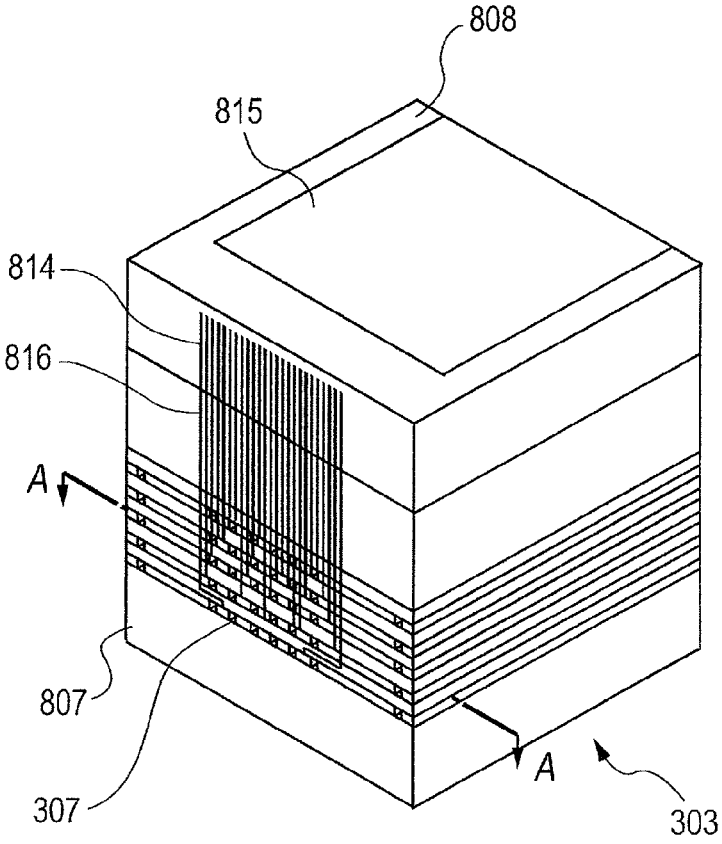
FIG. 18 is a schematic perspective view illustrating a pattern of lead-out wiring (SIG).

A rear end face electrode forming step is executed next to form a lead-out wiring (SIG) 816 from the SIG electrode provided in each individual liquid chamber 307 on the rear end face 807 of the ink jet head 303. FIG. 18 is a perspective view illustrating the lead-out wiring (SIG) 816. The lead-out wiring (SIG) 816 is connected to a mounted wiring connecting portion (SIG) 814, which is formed on the rear end face 807 on the upper end face 808 side, and is connected to the first FPC 310 (see FIGS. 1 and 2) in a step described later.

Electrode patterning on the rear end face 807 is described with reference to FIGS. 19A to 19D. FIGS. 19A to 19D are sectional views taken along the line A-A of FIG. 18.

It is difficult to form a uniform resist film by a normally employed application method, which uses a spin coater, on the rear end face 807, which has surface irregularities such as the individual liquid chambers 307. A film resist laminate is therefore suitable. A negative resist is used for the film.

In lift-off, a resist pattern is formed by photolithography so that the resist remains in parts where the electrode pattern is not to be left. A metal layer that is to constitute electrodes is formed on the entire rear end face 807, including the resist pattern, by performing sputtering or vapor deposition from above the resist pattern. The resist is then removed and a part of the metal film that has been formed above the resist is peeled off along with the resist. A desired metal film pattern is ultimately formed.

Figure 19A:
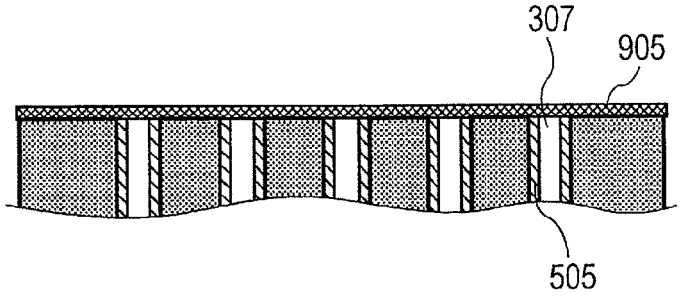
FIGS. 19A, 19B, 19C, and 19D are schematic sectional views taken along the line A-A of FIG. 18.
Figure 19B:
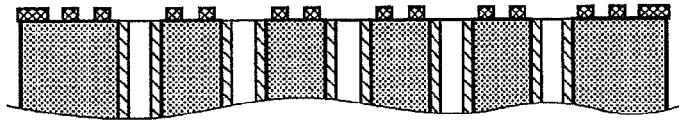
Figure 19C:
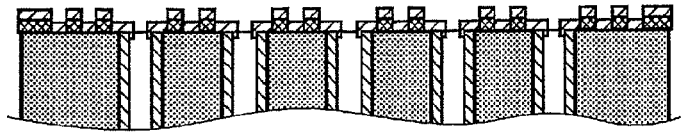
Figure 19D:
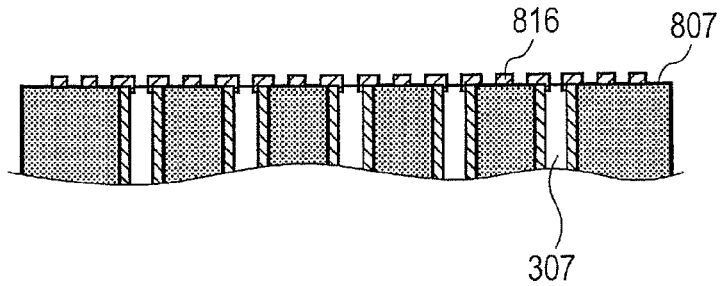

Specifically, a film resist 905 is laminated onto the rear end face 807 first as illustrated in FIG. 19A. The individual liquid chambers 307 and the peripheries thereof are next exposed by exposure and development as illustrated in FIG. 19B. An electrode layer is formed on the rear end face 807 as illustrated in FIG. 19C, thereby electrically connecting the electrode layer to the electrodes (SIG) 505 and 512 in the individual liquid chambers 307. The resist is then removed as illustrated in FIG. 19D, with the result that the electrode is formed to have a desired pattern by lift-off.

The electrodes are formed by, for example, forming a Cr film to a thickness of approximately 20 nm as a base layer and further forming an Au film to a thickness of approximately 1,000 nm as an electrode layer. Alternatively, the electrodes may be formed by forming a Cr film to a thickness of approximately 20 nm as a base layer, forming and patterning an approximately 50 nm-thick Pd film, conducting Ni plating with the Pd film as a seed layer to a thickness of approximately 1,000 nm, and conducting displacement plating in which Ni on the surface is displaced with Au. A gap of approximately 1 to 2 μm is provided by the adhesive layer between each piezoelectric substrate 501 and each piezoelectric substrate 502. The thickness of the gap is sufficient for obtaining electrical connection beyond the gap. The latter method which uses plating is particularly favorable because the thinness of the film in lift-off means an improved ease of patterning, and because the use of Au restricted to the surface keeps the cost low.

Thus, the electrodes formed on the inner walls of the individual liquid chambers 307 are each connected to one lead-out line (SIG), and all electrodes formed in the peripheries of the individual liquid chambers 307 are coupled to be connected to common lead-out wiring (GND). In each individual liquid chamber 307, walls in the periphery of the individual liquid chamber 307 can be driven (deformed) independently of other individual liquid chambers 307 by applying drive signals to the individually connected lead-out lines (SIG).

(Step S8) Rear Throttle Plate Bonding

Figure 20:
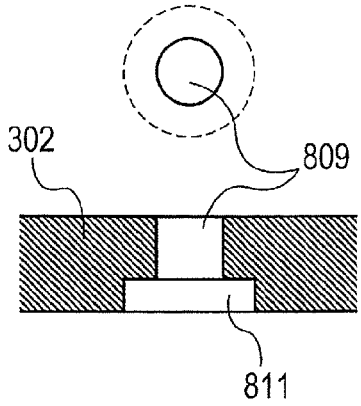
FIG. 20 is an enlarged diagram illustrating a rear throttle plate in plan view and side sectional view.
Figure 21:
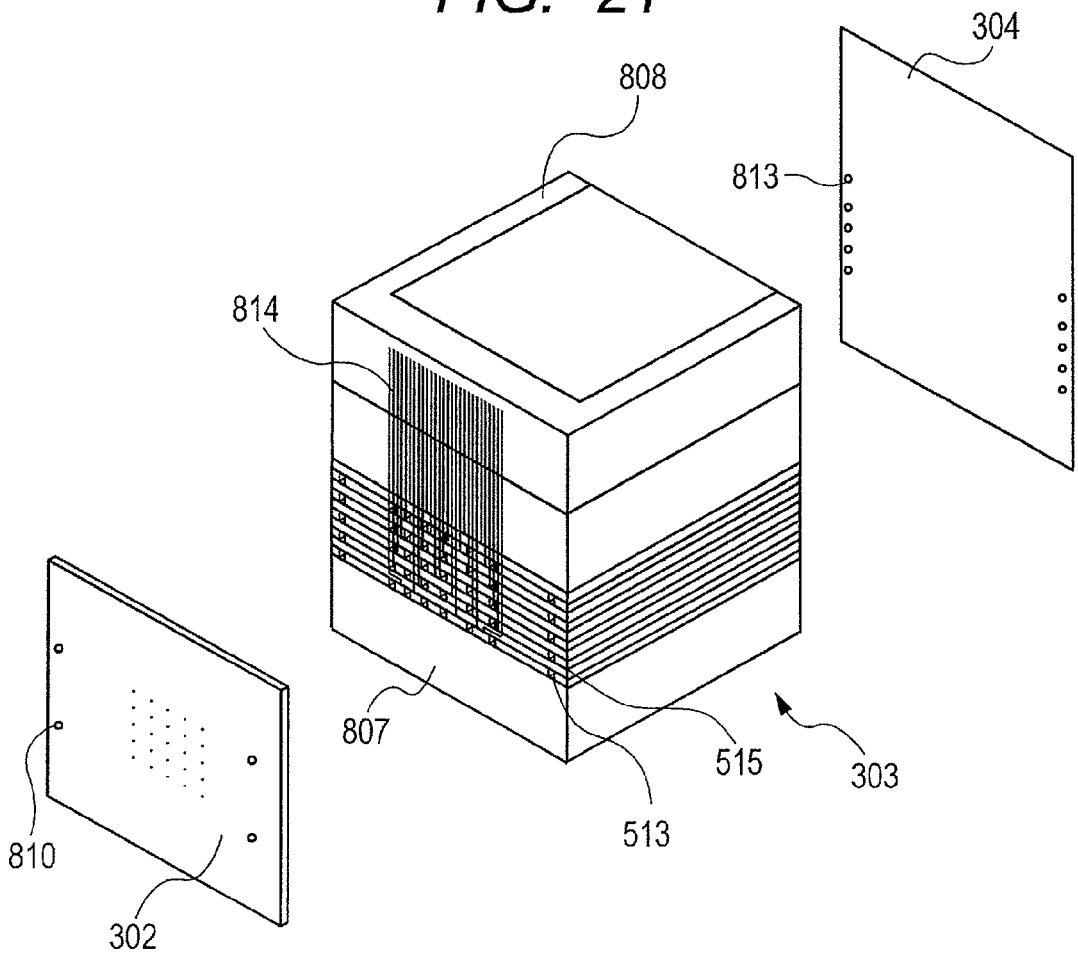
FIG. 21 is a schematic perspective view illustrating a plate bonding step.

A rear throttle plate bonding step for bonding the rear throttle plate 302 to the rear end face 807 of the ink jet head 303 is conducted next. FIG. 20 is a plan view and side sectional view of a point on the rear throttle plate 302 that corresponds to one of the individual liquid chamber 307. FIG. 21 is a schematic perspective view illustrating a positional relation that is observed when the rear throttle plate 302, the ink jet head 303, and the orifice plate 304 are joined.

As illustrated in FIG. 20, an opening (rear throttle) 809 is formed in the rear throttle plate 302 in a place that corresponds to the location of each individual liquid chamber 307. The opening 809 of the rear throttle plate 302 is provided for restricting the backwash of ink by making the flux of driven ink heavier on the ejection orifice 309 side of the orifice plate 304. The rear throttle plate 302 can be formed by, for example, etching a Si substrate. The opening 809 is smaller than the opening of each individual liquid chamber 307, for example, approximately 50 μm in diameter and approximately 200 μm in depth when each individual liquid chamber 307 has an opening that is a 120 μm×120 μm square in section. Forming an insulating film on the surface of the Si substrate by thermal oxidation or the like is preferred in order to prevent the short circuit of wiring formed in the ink jet head 303 when the rear throttle plate 302 is bonded to the ink jet head 303.

An epoxy-based adhesive, for example, can be used to bond the thus structured rear throttle plate 302 and the ink jet head 303. The amount of the adhesive needs to be controlled appropriately in order to avoid filling the opening 809 of the rear throttle plate 302 and the individual liquid chambers 307 with the adhesive. The adhesive can be applied by forming a thin uniform adhesive layer on another flat substrate through spin coating, screen printing, or the like, pressing a surface to be bonded against the adhesive layer, and then pulling the surface away. A thin uniform adhesive layer is thus formed on the bonding surface. After the adhesive is applied, the rear throttle plate 302 and the ink jet head 303 are positioned with a minute gap left between the rear throttle plate 302 and the ink jet head 303, and the rear throttle plate 302 and the ink jet head 303 are then bonded by pressure bonding. The thickness of the adhesive as a guide is about 4 μm before the bonding and about 2 μm after the bonding. The amount of adhesive that runs over to the individual liquid chambers 307 and the air chambers 308 is reduced effectively by forming a groove 811 on one face of the rear throttle plate 302 in a place that coincides with the location of the opening 809 as illustrated in FIG. 20 and using the groove 811 as a spillway for the adhesive.

As illustrated in FIG. 21, the joining-use alignment grooves 513 and 515 which are formed in the groove processing step described above (see FIGS. 6 and 10) can be checked from the rear end face 807 of the ink jet head 303. The rear throttle plate 302 is provided with rear throttle plate alignment holes 810 for positioning with the joining-use alignment grooves 513 and 515. The rear throttle plate 302 can therefore be positioned for bonding with the use of the joining-use alignment grooves 513 and 515 and the rear throttle plate alignment holes 810.

The rear throttle plate 302 is bonded to the rear end face 807 of the ink jet head 303 so that the mounted wiring connecting portion (SIG) 814 provided in the rear end face electrode forming step is exposed.

(Step S9) Insulation

An insulating film is formed next on the surface of the electrodes formed on the inner walls of the individual liquid chambers 307, the surface of the electrodes formed on the inner walls of the air chambers 308, and the surface of the electrode wiring (lead-out wiring). However, the insulating film is not formed on a part of the lead-out wiring that is connected to the FPCs, namely, the mounted wiring connecting portions 814 and 815. These portions are therefore masked with tape or the like when the insulating film is formed.

The insulating film is formed by, for example, chemical vapor deposition (CVD). A particularly preferred material of the insulating film that reaches the far walls of the individual liquid chambers 307 is parylene (N) which has excellent covering ability. The appropriate thickness of the insulating film is approximately 5 μm. It is preferred to perform UV-ozone treatment at room temperature for about five minutes before a parylene film is formed in order to improve the adhesion of the parylene film. The adhesion of the parylene film may be improved further by applying a coupling agent after the UV-ozone treatment. In the case where Au is used for the lead-out wiring (GND) 817 on the front end face 806 of the ink jet head 303, in particular, surface treatment that uses a triazine thiol-based coupling agent is effective for the markedly low adhesion between Au and parylene. In the case where a Si substrate is used for the rear throttle plate 302 and an oxide film is formed on the surface of the Si substrate, a silane coupling agent is effective. The coupling treatment is accomplished by thinly applying a coupling agent that is diluted with isopropyl alcohol (IPA) and drying in an oven.

(Step S10) Orifice Plate Bonding

Figure 22:
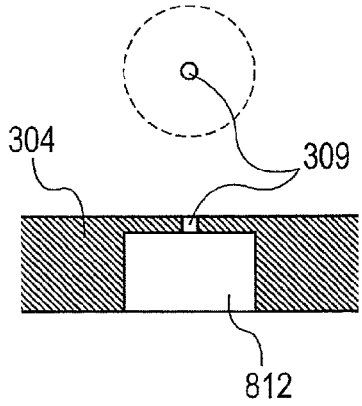
FIG. 22 is an enlarged diagram illustrating an orifice plate in plan view and side sectional view.

An orifice plate bonding step is executed next to bond the orifice plate 304 to the front end face 806 of the ink jet head 303. FIG. 22 is a top view and side sectional view of a point on the orifice plate 304 that corresponds to one of the individual liquid chambers 307.

As illustrated in FIG. 22, one ejection orifice 309 which is a through-hole is formed in the orifice plate 304 in a place that corresponds to the location of each individual liquid chamber 307. Each ejection orifice 309 is, for example, a round hole that has a diameter of 10 μm and a depth of 20 μm. A spillway 812 for preventing the adhesive from blocking the ejection orifice 309 is provided on a face of the orifice plate 304 that is bonded to the ink jet head 303 as illustrated in FIG. 22. In order to prevent ink from retaining bubbles, it is preferred to set the spillway 812 smaller than the opening of each individual liquid chamber 307 in section. For instance, the spillway 812 can be 80 μm in width and 60 μm in depth. The overall thickness of the orifice plate 304 in this case is 80 μm.

This orifice plate 304 is fabricated by, for example, electroforming of Ni. Ink repellent treatment is further performed on a face of the orifice plate 304 that is not brought into contact with the front end face 806 of the ink jet head 303. Silane-based materials and fluorine-based materials are given as ink repellent material examples. Coating treatment using an ink repellent material is conducted by vapor deposition or the like.

An epoxy-based adhesive, for example, can be used to bond the orifice plate 304 and the ink jet head 303. The amount of the adhesive needs to be controlled appropriately in order to avoid filling the ejection orifices 309 of the orifice plate 304 and the individual liquid chambers 307 with the adhesive. The adhesive can be applied by forming a thin uniform adhesive layer on another flat substrate through spin coating, screen printing, or the like, pressing a surface to be bonded against the adhesive layer, and then pulling the surface away. A thin uniform adhesive layer is thus formed on the bonding surface. After the adhesive is applied, the orifice plate 304 and the ink jet head 303 are positioned with a minute gap left between the orifice plate 304 and the ink jet head 303, and the orifice plate 304 and the ink jet head 303 are then bonded by pressure bonding. The thickness of the adhesive as a guide is about 4 μm before the bonding and about 2 μm after the bonding.

The joining-use alignment grooves 513 and 515 which are formed in groove processing step described above (see FIGS. 6 and 10) can be checked from the front end face 806 of the ink jet head 303 as from the rear end face 807. The orifice plate 304 is provided with orifice plate alignment holes 813 for positioning with the joining-use alignment grooves 513 and 515 as illustrated in FIG. 21. The orifice plate 304 can therefore be positioned for bonding with the use of the joining-use alignment grooves 513 and 515 and the orifice plate alignment holes 813.

(Step S11) Wiring Mounting

Figure 23:
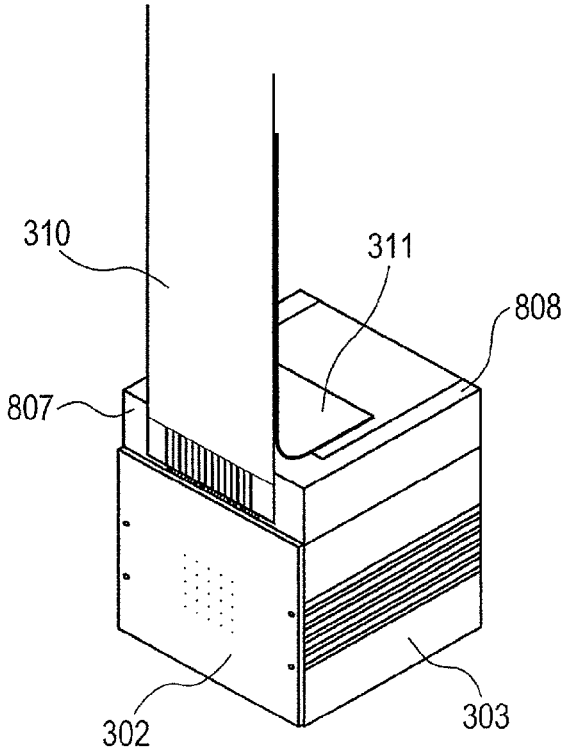
FIG. 23 is a schematic perspective view illustrating a wiring mounting step.

A wiring mounting step is executed next to press-fit the FPCs to the lead-out wiring from the electrodes. Specifically, the first FPC 310 and the second FPC 311 are respectively press-fit to the lead-out wiring (SIG) led out to the rear end face 807 of the ink jet head 303 and the lead-out wiring (GND) led out to the upper end face 808 as illustrated in FIG. 23. An anisotropic conductive film (ACF) can be used for the press-fitting. Suitable press-fitting conditions include setting the press-fit temperature to 150° C., setting the press-fit pressure to 3 MPa, and setting the press-fit time to approximately 10 seconds. After the press-fitting, parts around where the FPCs are joined to the lead-out wiring are reinforced with an adhesive.

(Step S12) Common Liquid Chamber Bonding

Thereafter, the common liquid chamber 301 which has an ink supply port 305 is prepared by, for example, machining of an SUS substrate. Common liquid chamber bonding is then conducted in which the common liquid chamber 301 is joined to the rear throttle plate 302 with an adhesive as illustrated in FIGS. 1 and 2.

Lastly, other necessary components are assembled to complete the ink jet head 303.

Figure 24A:
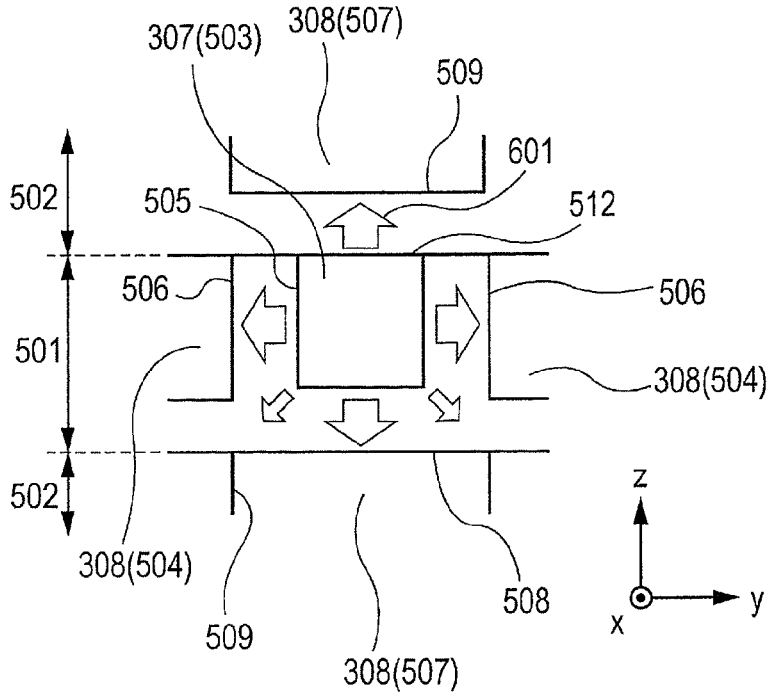
FIGS. 24A and 24B are schematic plan views illustrating an enlarged region A of FIG. 3 and the periphery thereof.
Figure 24B:
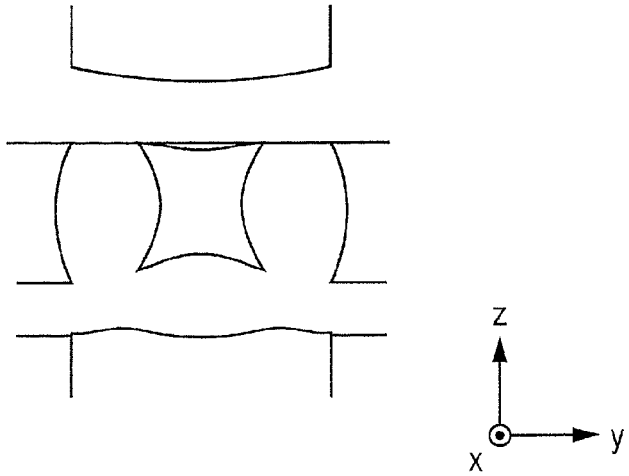

The operation of driving the ink jet head 303 is described next with reference to FIGS. 24A and 24B. FIGS. 24A and 24B are schematic plan views illustrating an enlarged region A of FIG. 3 and the periphery thereof that are viewed from the ink ejection direction. FIG. 24A illustrates how the region A and its periphery look when drive voltage is not applied. FIG. 24B illustrates how the region A and its periphery look when drive voltage is being applied.

The individual liquid chambers 307 are arranged in a lattice pattern on the yz plane, and the air chambers 308 are arranged around the respective individual liquid chambers 307 at a distance from the individual liquid chambers 307. Partition walls separating the individual liquid chambers 307 and the air chambers 308 from each other are polarized in a polarization direction 601, which travels outward in the radial directions of the openings of the individual liquid chambers 307.

The electrodes (SIG) 505 and 512 formed on the inner walls of the individual liquid chambers 307 are given a positive electric potential, the electrodes (GND) 506, 508, and 509 formed on the inner walls of the air chambers 308 are given a GND electric potential, and drive voltage is applied between the SIG electrodes and the GND electrodes. This causes the partition walls constituting the individual liquid chambers 307 to deform so that the individual liquid chambers 307 are shrunk as illustrated in FIG. 24B. The deformation raises pressure on the ink filling the individual liquid chambers 307, with the result that drops of ink are ejected from the ejection orifices. The electrodes (SIG) 505 and 512 formed on the inner walls of the individual liquid chambers 307 may also be given a GND electric potential whereas the electrodes (GND) 506, 508, and 509 formed on the inner walls of the air chambers 308 are given a positive electric potential, and drive voltage is applied between the SIG electrodes and the GND electrodes. In this case, the partition walls constituting the individual liquid chambers 307 are deformed so that the individual liquid chambers 307 expand (not shown).

The shrinkage of the individual liquid chambers 307 described above changes depending on the structure of the electrodes that are formed on the inner walls of the individual liquid chambers 307. Specifically, the shrinkage is changed by changing the dimensions and arrangement of strip-shaped counter electrodes (the fifth electrode (SIG) 512) which are opposed to the first grooves 503, with respect to inner surface electrodes (the first electrodes (SIG) 505) which are formed on the inner faces of the first grooves 503. Setting the dimensions and arrangement of the fifth electrode (SIG) 512 in an optimum range therefore keeps the shrinkage amount (deformation amount) of the individual liquid chambers 307 constant even when there is misalignment between the piezoelectric substrates 501 and 502 that are stacked. Fluctuations in ejection performance from one ejection orifice to another can thus be reduced. This effect is described below with reference to FIGS. 25A to 25D and FIG. 26.

FIGS. 25A to 25D are plan views schematically illustrating the dimensions and arrangement relation of one first electrode (SIG) 505 and one fifth electrode (SIG) 512 on the yz plane. The fifth electrode (SIG) 512 in FIGS. 25A to 25D is distanced from the first electrode (SIG) 505. In actuality, the fifth electrode (SIG) 512 is electrically connected to the first electrode (SIG) 505 as illustrated in FIGS. 24A and 24B. FIG. 26 is a graph showing the relation between a width $W_2$ of the fifth electrode (SIG) 512 and the shrinkage sectional area of the relevant individual liquid chamber 307 that is registered when a drive electric field is applied. The relation is obtained by structural analysis simulation. In the following description, the width of each groove means a width in the y direction (the second direction) perpendicular to the x direction in which the groove extends and to the stacking direction of the stacked body of the ink jet head 303 (the z direction).

Figure 25A:
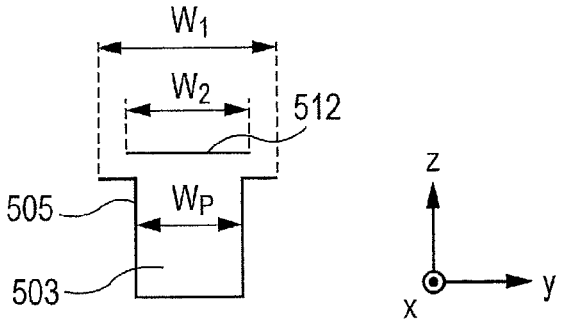
FIGS. 25A, 25B, 25C, and 25D are plan views schematically illustrating the positional relation between a first electrode and a fifth electrode.
Figure 26:
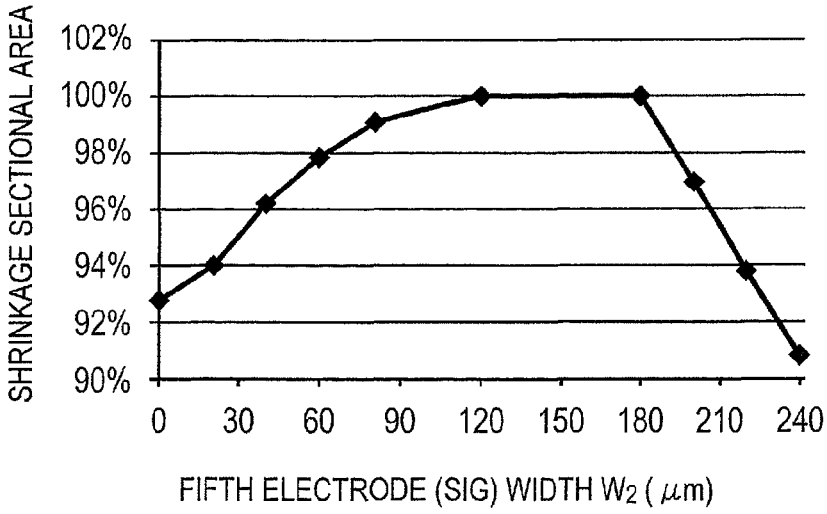
FIG. 26 is a graph showing results of simulating the shrinkage sectional area of an individual liquid chamber.

In FIG. 25A, a width $W_1$ of the first electrode (SIG) 505, the width $W_2$ of the fifth electrode (SIG) 512, and a width $W_P$ of one first groove 503 satisfy a relation of $W_P<W_2<W_1$. Accordingly, when the width $W_P$ of the first groove 503 is 120 μm and the width $W_1$ of the first electrode (SIG) 505 is 180 μm, the shrinkage sectional area of the individual liquid chamber 307 does not change if the width $W_2$ of the fifth electrode (SIG) 512 is within a range of 120 μm to 180 μm. Shown in FIG. 26 are results of simulation in which the width $W_2$ of the fifth electrode (SIG) 512 is changed from 0 μm to 240 μm when the width $W_P$ of the first groove 503 is 120 μm and the width $W_1$ of the first electrode (SIG) 505 is 180 μm. It can be seen in FIG. 26 that the shrinkage sectional area of the individual liquid chamber 307 is constant when the width $W_2$ of the fifth electrode (SIG) 512 is 120 μm to 180 μm.

Figure 25B:
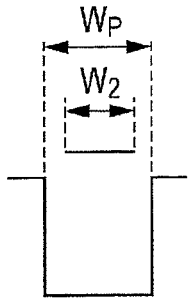

In FIG. 25B, on the other hand, the width $W_2$ of the fifth electrode (SIG) 512 and the width $W_P$ of the first groove 503 satisfy a relation of $W_2<W_P$. The width $W_2$ of the fifth electrode (SIG) 512 in this case is 120 μm or less, and the shrinkage sectional area of the individual liquid chamber 307 is therefore smaller when the width $W_2$ of the fifth electrode (SIG) 512 is narrower as illustrated in FIG. 26. This is because the discontinuous presence of electrodes creates a region in the second piezoelectric substrate 502 that is hard to deform.

Figure 25C:
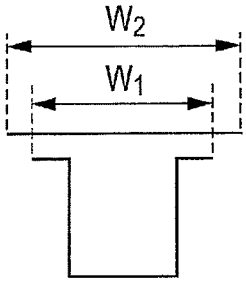

In FIG. 25C, the width $W_1$ of the first electrode (SIG) 505 and the width $W_2$ of the fifth electrode (SIG) 512 satisfy a relation of $W_1<W_2$. The width $W_2$ of the fifth electrode (SIG) 512 in this case is 180 μm or more, and the shrinkage sectional area of the individual liquid chamber 307 is therefore smaller when the width $W_2$ of the fifth electrode (SIG) 512 is wider as illustrated in FIG. 26. This is because the direction of the electric field applied to the piezoelectric body in the side wall portions of the individual liquid chamber 307 (the first groove 503) in the y direction changes with the widening of the electrode width.

Figure 25D:
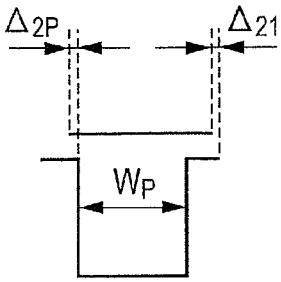

FIG. 25D shows misalignment between the first piezoelectric substrate 501 and the second piezoelectric substrate 502 in the y direction (a misalignment amount δ). In this case, the width of a part of the fifth electrode (SIG) 512 that juts out of the edge of the first groove 503 is expressed by $\Delta_{2P}=((W_2-W_P)/2)-\delta$. The width of a part of the first electrode (SIG) 505 that juts out of the edge of the fifth electrode (SIG) 512 is expressed by $\Delta_{21}=((W_1-W_2)-\delta$. If the widths $\Delta_{2P}$ and $\Delta_{21}$ of the jutting parts are both 0 or more, the inconveniences of FIG. 25B and FIG. 25C are not caused and the shrinkage sectional area of the individual liquid chamber 307 does not change even when the misalignment described above occurs. In other words, the shrinkage sectional area of the individual liquid chamber 307 does not change even when the piezoelectric substrates are misaligned by the misalignment amount δ if the width $W_2$ of the fifth electrode (SIG) 512 is set within a range where $W_P+2\delta<W_2<W_1-2\delta$ is satisfied. For instance, when $W_P$ is 120 μm and $W_1$ is 180 μm, setting $W_2$ within a range of 140 μm to 160 μm ensures that the shrinkage sectional area of the individual liquid chamber 307 does not change despite a misalignment δ of 10 μm.

As has been described, the ink jet head of this embodiment is enhanced in the rigidity of the peripheries of the individual liquid chambers, compared to a structure in which wall portions constituting the respective individual liquid chambers are constructed independently of one another. In addition, the ink jet head of this embodiment is capable of keeping the shrinkage amount of the individual liquid chambers constant even when piezoelectric substrates that are stacked are misaligned.

The liquid ejection head of the present invention is applicable to a printing device, an application device, or a device for additive manufacturing that ejects drops of liquid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-140705, filed Jun. 22, 2012, which is hereby incorporated by reference herein in its entirety.

What is claimed is:

1. A liquid ejection head, comprising:

multiple tubular pressure chambers that respectively communicate with ejection orifices for ejecting liquid, and hold the liquid to be ejected from the ejection orifices, wall portions constituting the multiple tubular pressure chambers being formed of a piezoelectric material and configured to eject the liquid from the ejection orifices by deforming the piezoelectric material; and a stacked body in which first substrates formed of a piezoelectric material and second substrates formed of a piezoelectric material are stacked alternately with each other, wherein, on one face of each of the first substrates, multiple first grooves and multiple second grooves are formed, the multiple first grooves extending in a first direction and constituting the multiple tubular pressure chambers together with one of the second substrates, the multiple second grooves being arranged alternately with the multiple first grooves and constituting spaces together with the one of the second substrates, wherein, on a face of each of the second substrates that is opposed to a face brought into contact with the one face of each of the first substrates, multiple third grooves are formed which extend in the first direction and which constitute the spaces together with one of the first substrates, wherein, in the multiple first grooves of each of the first substrates, inner surface electrodes are formed which extend from inside the multiple first grooves to each outer side of the multiple first grooves, wherein counter electrodes extending in the first direction are formed in the face of each of the second substrates that is brought into contact with the one face of each of the first substrates in places opposed to the multiple first grooves, and wherein a width $W_1$ of each of the inner surface electrodes, a width $W_2$ of each of the counter electrodes, and a width $W_P$ of each of the multiple first grooves satisfy a relation of $W_P<W_2<W_1$ in a second direction, which is perpendicular to the first direction and to a stacking direction of the stacked body.

2. The liquid ejection head according to claim 1, wherein the multiple third grooves are formed in places opposed to the multiple first grooves, and wherein electrodes are formed inside the multiple third grooves to have a width in the second direction that is greater than the width of each of the inner surface electrodes.

3. The liquid ejection head according to claim 1, wherein each of the second substrates is polarized in the stacking direction.

4. The liquid ejection head according to claim 1, wherein, when an amount of misalignment between each of the first substrates and each of the second substrates along the second direction is δ, the width of each of the inner surface electrodes, the width of each of the counter electrodes, and the width of each of the multiple first grooves satisfy a relation of $W_P+2\delta<W_2<W_1-2\delta$.

* * * * *